United States Patent [19]

Tanaka et al.

[11] Patent Number: 4,972,562

[45] Date of Patent: Nov. 27, 1990

[54] ELECTRONICALLY CONTROLLED SAMPLE WARPER

[75] Inventors: Yoshihiro Tanaka; Takatsugu Aihara; Minoru Otsuka, all of Kiryu, Japan

[73] Assignee: Suzuki Warper, Ltd., Kiryu, Japan

[21] Appl. No.: 440,134

[22] Filed: Nov. 22, 1989

[30] Foreign Application Priority Data

Dec. 22, 1988 [JP] Japan ..... 63-324306

[51] Int. Cl.[5] ..... D02H 3/00; H02P 7/63

[52] U.S. Cl. ..... 28/190; 242/47

[58] Field of Search ..... 242/47; 28/190, 191

[56] References Cited

FOREIGN PATENT DOCUMENTS 63-35845 2/1988 Japan .
63-35846 2/1988 Japan .

*Primary Examiner*—Werner H. Schroeder
*Assistant Examiner*—Bradley Kurtz DeSandro
*Attorney, Agent, or Firm*—Armstrong, Nikaido, Marmelstein, Kubovcik & Murray

[57] ABSTRACT

An electronically controlled sample warper capable of warping a plurality of warp yarns simultaneously. In the warper, a plurality of warp yearns can be concurrently wound on a warping drum with omitting a yarn exchanging step to eliminate any time loss for the yarn exchange, thus reducing the warping period of time.

1 Claim, 31 Drawing Sheets

FIG.10b(1)
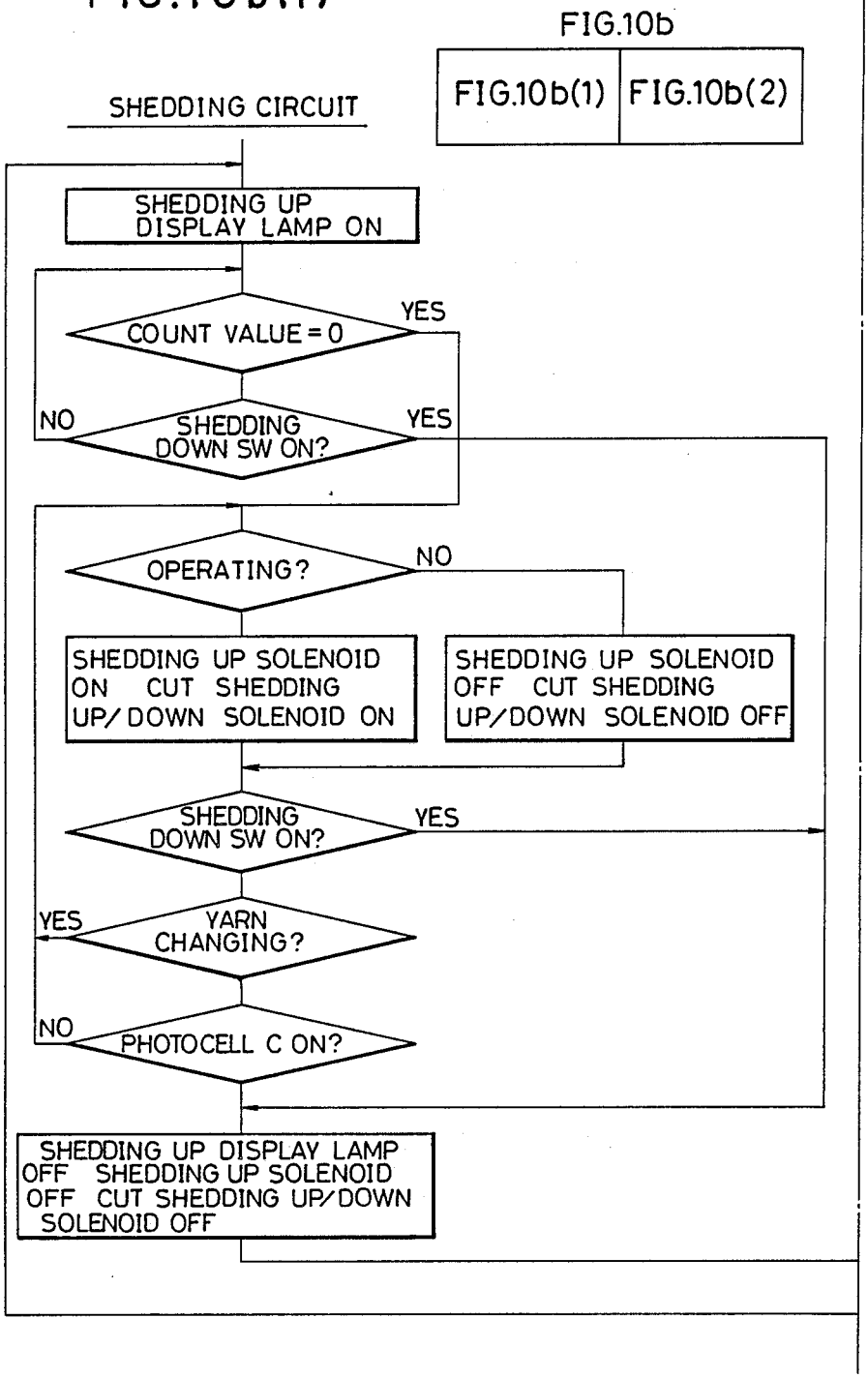

FIG. 10b(2)
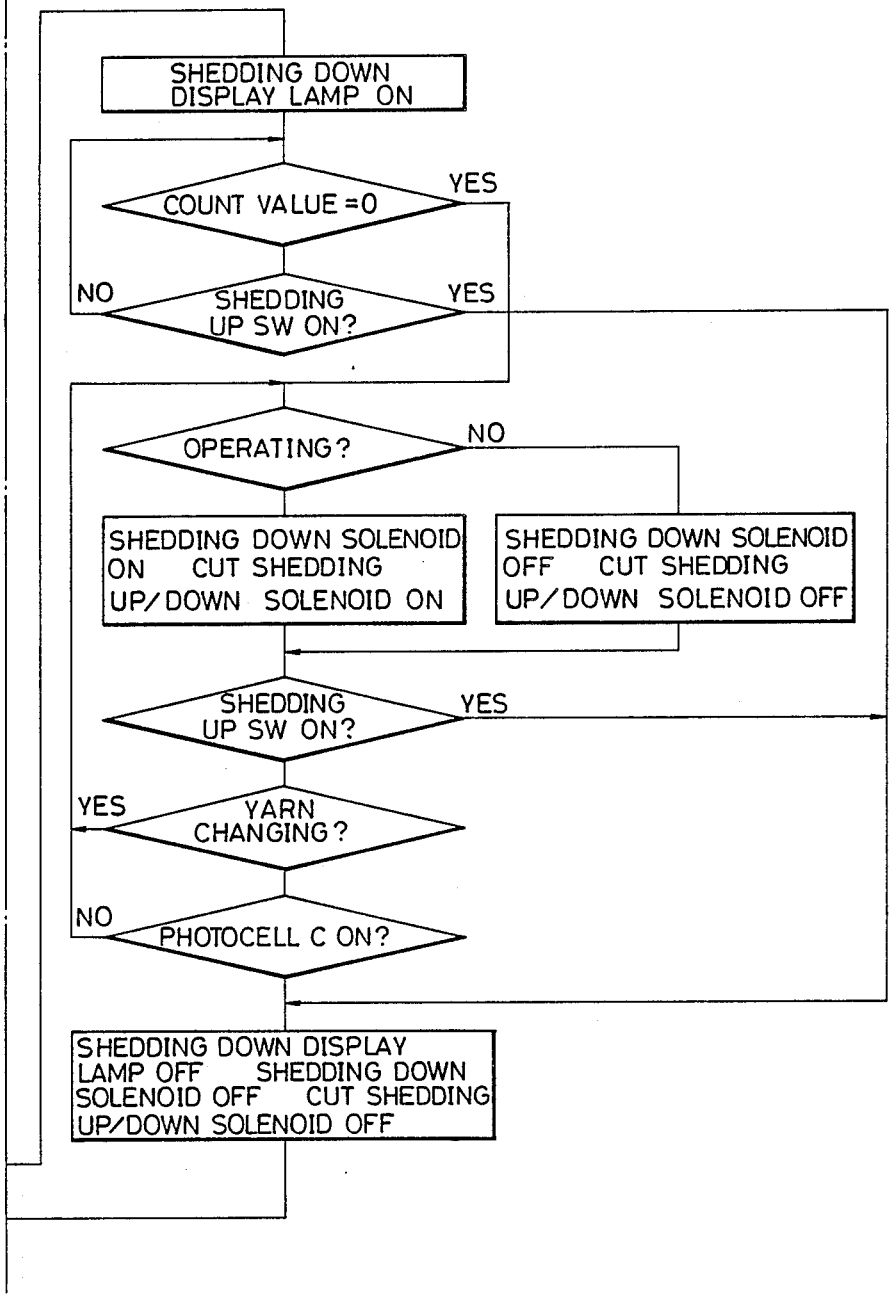

| |
|---|
| FIG.10h(1) |
| FIG.10h(2) |

FIG.10h(1)

YARN SELECTION CIRCUIT

FIG.10h(2)
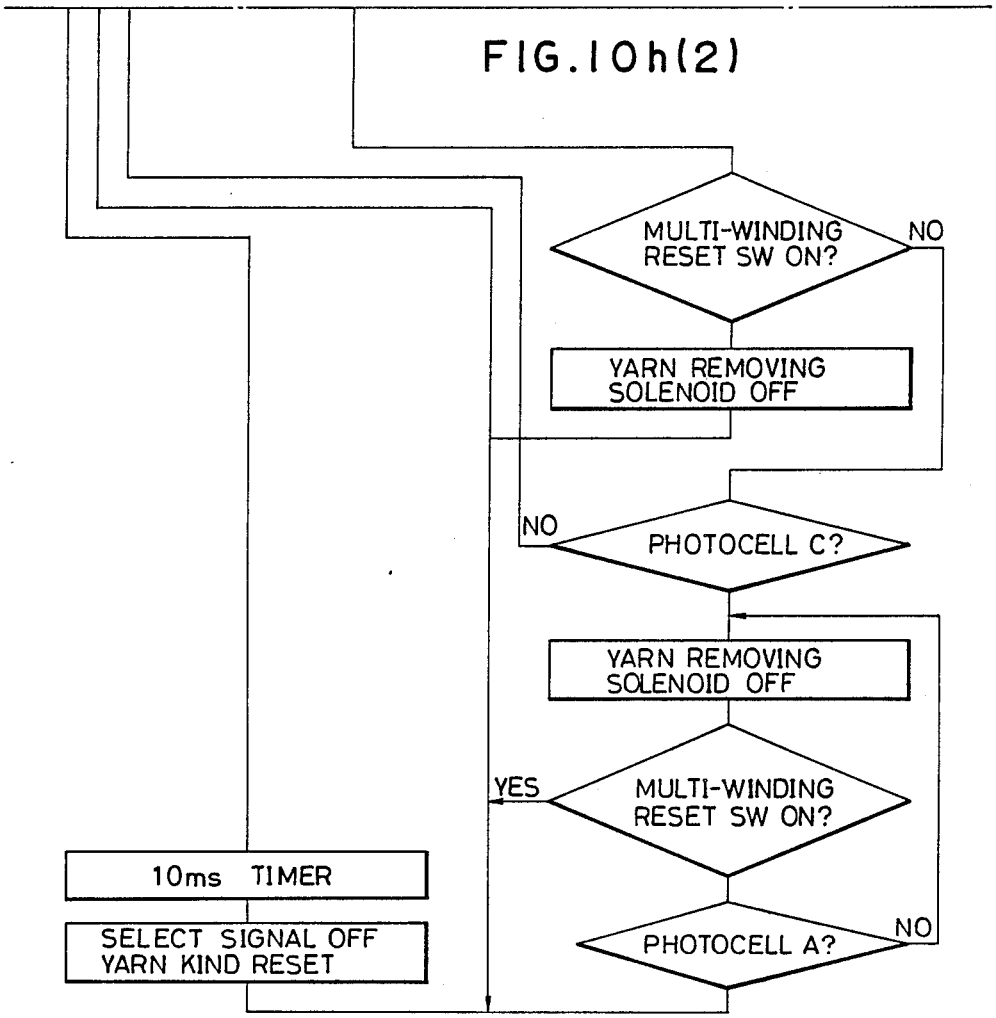

FIG.10b'(1)

| FIG.10b'(1) | FIG.10b'(2) |
|---|---|

SHEDDING CIRCUIT
(WHEN USING ROTARY CREEL)

FIG. 10b'(2)
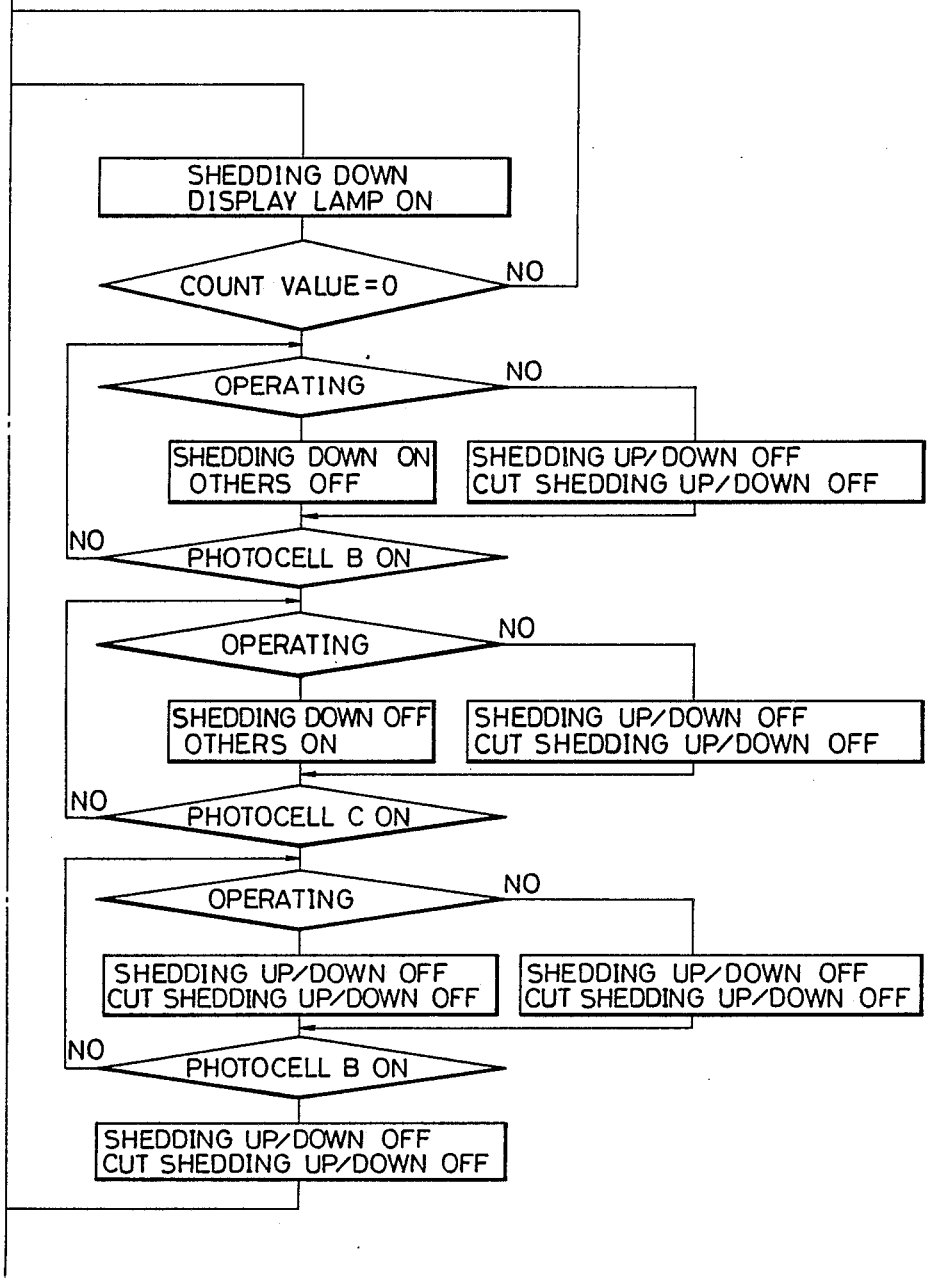

TOTAL YARNS COUNTER
COUNT CIRCUIT (WHEN USING ROTARY CREEL)

ELECTRONICALLY CONTROLLED SAMPLE WARPER

BACKGROUND OF THE INVENTION

1. Field of the Invention:

This invention relates to an electronically controlled sample warper capable of warping a plurality of warp yarns simultaneously. In the warper, a plurality of warp yarns can be concurrently wound on a warping drum with omitting a yarn exchanging step to eliminate any time loss for the yarn exchange, thus reducing the warping period of time.

2. Description of the Related Art:

Conventional electronically controlled sample warpers are exemplified by Japanese Patent Laid-Open Publication No. 62942/1987, which generally comprises: driving and driven shafts 2, 3 projecting centrally from opposite ends of a hollow shaft 1 cantilevered at the driving-shaft side; a first small gear 5 loosely mounted on the driving shaft 2 and fixed to a pulley 4; a second small gear 7 loosely mounted on the driven shaft 3 and fixed to a yarn introduction lever 6; third and fourth small gears 9, 10 mounted on opposite ends of an auxiliary shaft 8 extending through the hollow shaft 1 and meshing the first and second small gears 5, 7, respectively, to cooperate with each other; drum frames 13, 14 mounted on the driven-shaft side of the hollow shaft 1 and each having an outer periphery having alternately an arcuate portion 11 and a straight portion; a pair of rollers 15 disposed one on the arcuate portion 11 of each of the drum frames 13, 14; and a warper drum A loosely mounted on the hollow shaft 1 and having horizontal beams 16 carrying the rollers 15 around which conveyor belts 17 are wound. The conveyor belts 17 are simultaneously driven to a common amount of fine movement by a drive member 21 threadedly engaged with interior screw shafts 20 of planetary gears 19 meshing with a sun gear 18 suitably driven from the exterior; as the sun gear 18 rotates, the planetary gears 19 rotates concurrently. The distal end of the yarn introduction lever 6 is bent inwardly to provide an yarn introducing part 6' disposed adjacent to the front end of the outer periphery of the warper drum A. The warper also includes: a shedding means for forming a shed and a cut shed by selecting warp yarns (to be wound on the warper drum) over and under shedding bars and cut shedding bars; a total yarns counter count means for rendering an up signal, of a total counter for counting the total number of the warp yarns, to be on or off; a total yarns completion termination means for terminating the operation of the warper when the total number of the warp yarns reaches a predetermined value; a conveyor belt leftward moving means for moving the conveyor belt leftwardly; a conveyor belt rightward moving means for moving the conveyor belt rightwardly; an operation/termination means for transmitting the rotation of a main motor 46 to the yarn introduction lever 6; a yarn selection means for controlling a yarn selection guide 27 and a yarn removing unit 32; a yarn pressing solenoid means for rendering a solenoid of a yarn relaxation preventing (yarn pressing) unit 60 operative and inoperative; and a windings count means for counting the number of windings of the yarns and for displaying the counted result. By selecting the kind of yarn 0–n, and setting the number of yarns, the number of repeats, the number of windings, the quantity of movement of the conveyor belt, a desired pattern of warping can be achieved automatically. The reference numerals used here are similar to those used in an embodiment of this invention described below.

However, in this conventional warper, since an ordinary motor is used as the main motor, it is impossible to vary the rate of rotations during operating so that miscatches and mischanges as well as yarn breakage are inevitable when exchanging yarns. And it is impossible to terminate relaxing and to perform jogging, thus causing only inadequate operating efficiency. For setting the density of warp yarns, the rate of moving the conveyor belt is determined by varying the gear ratio of speed change gears operatively connected to the main motor Since the conveyor belt is moved even during idling, regular windings of yarns on the warper drum are difficult to achieve so that the tension and the warp length would finely vary during. In order to overcome the abovementioned problems, proposals have been made to employ an inverter motor or an AC servo motor in the warper (Japanese Patent laid-Open Publications Nos. 35845/1988 and 35846/1988).

However, in the last-mentioned conventional warpers, since always only a single yarn is engaged on the yarn introducing part, it is impossible to wind two or more yarns concurrently on the yarn introducing part. Further, since the main motor is reduced in speed and idled one or two times, during exchanging yarns, in order to avoid miscatching, mischanging, or other misoperating, the warping operation is wasteful in part. Yet assuming that two or more yarns are engaged on the single yarn introduction part in order to omit this yarn exchanging step, two or more yarns could be wound on the warper drum, but alternate an accurate selection of yarns one at a time for the shedding bar and the cut shedding up and down is impossible.

SUMMARY OF THE INVENTION

It is therefore an object of this invention to provide an electronically controlled sample warper capable of warping a plurality of warp yarns simultaneously, in which the step of exchanging yarns can be omitted and in which the warping period of time can be reduced to a minimum.

According to this invention, there is provided an electronically controlled sample warper for automatically warping in a desired pattern or yarns by selecting the kinds of yarns from 0 through n and by setting the number of yarns, the number of repeats, the number of windings, the amount of movement of a conveyor belt, which comprises: driving and driven shafts 2, 3 projecting centrally from opposite ends of a hollow shaft 1 cantilevered at the driving-shaft side; a first small gear 5 loosely mounted on the driving shaft 2 and fixed to a pulley 4; a second small gear 7 loosely mounted on the driven shaft 3 and fixed to a yarn introduction lever 6, the distal end of the yarn introduction lever 6 being bent inwardly to provide a yarn introducing part 6' disposed adjacent to the front end of the outer periphery of the warper drum A; third and fourth small gears 9, (10) mounted on opposite ends of an auxiliary shaft 8 extending through the hollow shaft 1 and meshing the first and second small gears 5, 7, respectively, to cooperate with each other; drum frames 13, 14 mounted on the driven-shaft side of the hollow shaft 1 and each having an outer periphery having alternately an arcuate portion 11 and a straight portion; a pair of rollers 15 disposed one on the arcuate portion 11 of each of the drum frames 13, 14;

a warper drum A loosely mounted on the hollow shaft 1 and having horizontal beams 16 carrying the rollers 15 around which conveyor belts 17 are wound, the conveyor belts 17 being simultaneously driven to a common amount of fine movement by a drive member 21 threadedly engaged with interior screw shafts 20 of planetary gears 19 meshing with a sun gear 18 suitably driven from the exterior; as the sun gear 18 rotates, the planetary gears 19 rotates concurrently; a shedding means for forming a shed and a cut shed by selecting the warp yarns over and under shedding bars 33, 38, 34 and cut shedding bars 35, 37; a total yarns counter count means for rendering an up signal, of a total counter for counting the total number of the warp yarns, to be on or off; a total yarns completion termination means for terminating the operation of the warper when the total number of the warp yarns reaches a predetermined value; a conveyor belt leftward moving means for moving the conveyor belt 17 leftwardly; a conveyor belt rightward moving means for moving the conveyor belt 17 rightwardly; an operation/termination means for transmitting the rotation of a main motor 46 to the yarn introduction lever 6; a yarn selection means for controlling a yarn selection guide 27 and a yarn removing unit 32; a yarn pressing solenoid means for rendering a solenoid of a yarn relaxation preventing unit 60 operative and inoperative; and a windings count means for counting the number of windings of the yarns and for displaying the counted result; characterized in that the warper includes a plurality of the yarn introduction levers 6 each having a distal end inwardly bent to provide a yarn introduction part 6', and also includes a rotary creel F for supporting a plurality of bobbins on which a plurality of kinds of yarns are wound respectively.

The above and other advantages, features and additional objects of this invention will be manifest to those versed in the art upon making reference to the following detailed description and the accompanying drawings in which a structural embodiment incorporating the principles of this invention is shown by way of illustrative example.

DETAILED DESCRIPTION

Figure 1:
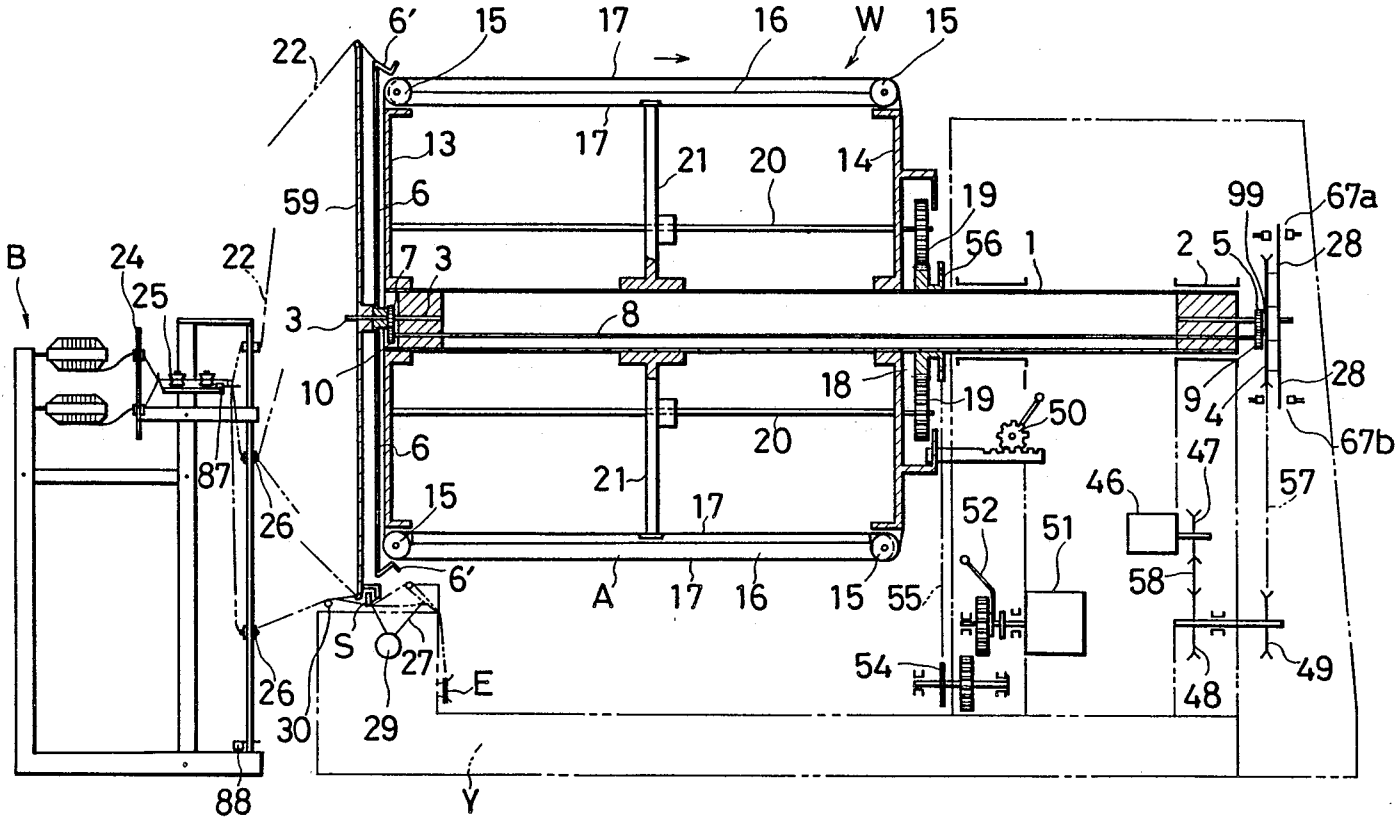
FIG. 1 is a side elevational view, with parts broken away, of an electronically controlled sample warper embodying this invention, which is associated with a fixed creel.
Figure 2:
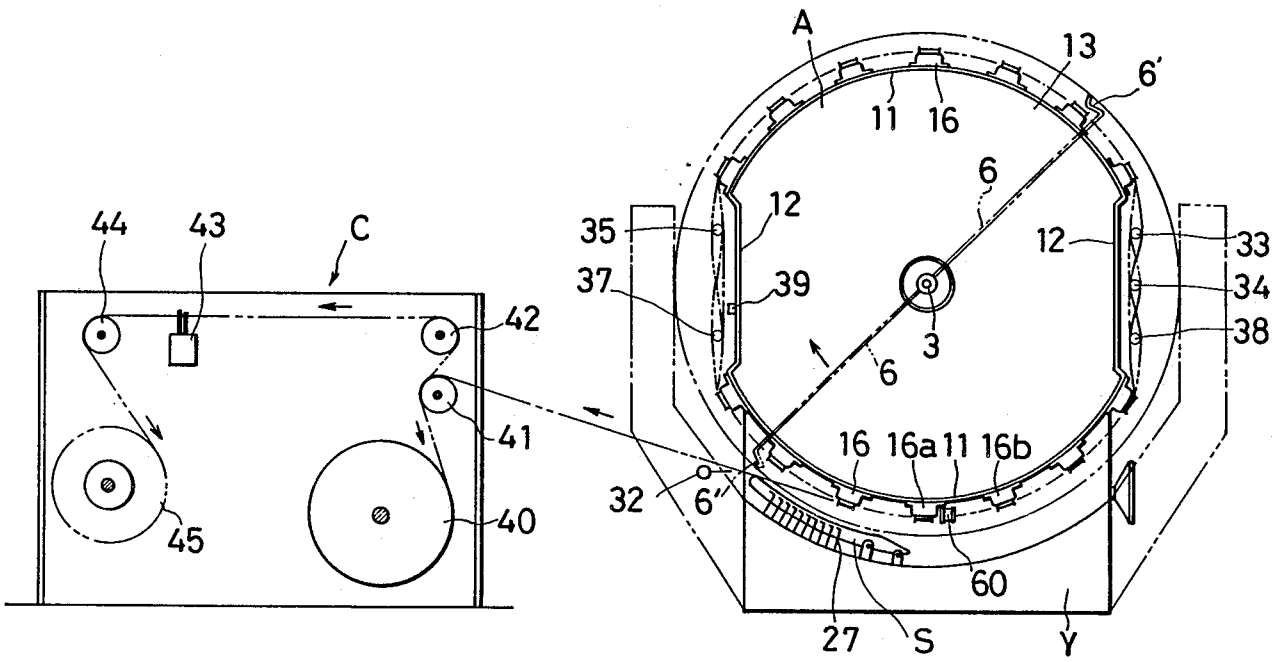
FIG. 2 is a front elevational view of the sample warper, which is associated with a rewinder.

The principles of this invention are particularly useful when embodied in an electrically controlled sample warper such as shown FIGS. 1 through 4, generally designated by the reference character W.

As shown in FIGS. 1 through 4, the sample warper W has a hollow shaft 1. A driving shaft 2 and a driven shaft 3 project centrally from respective opposite ends of the hollow shaft 1. On the driving shaft 2, a first small gear 5 and a pulley 99 both fixed to a pulley 4; on the driven shaft 3, a second gear 7 to which a pair of yarn introduction levers 6, 6 is fixed is loosely mounted. A pulley 98 is operatively connected with the pulley by a timing belt and is fixed to a shaft, on an extension of which an encoder 97 is mounted. The first and second small gears 5, 7 is in meshing engagement with third and fourth small gear 9, 10, respectively, which are mounted on opposite ends on a cooperating shaft 8 extending through the hollow shaft 1. Thus the first and second small gears 5, 7 are cooperatively connected with the third and fourth small gears 9, 10. The hollow shaft 1 is cantilevered at the driving-shaft side; on the drivenshaft side of the hollow shaft 1, a warper drum A is loosely mounted. The warper drum A is composed of a pair of drum frames 13, 14 each having an outer periphery having alternately arcuate and straight portions 11, 12. The warper drum A also includes horizontal beams 16 each supporting on its opposite ends a pair of rollers 15, 15 each resting on the arcuate portion 11 of each drum frame 13, 14. A conveyor belt 17 is wound round each pair of rollers 15, 15. All of the conveyor belts 17 are driven concurrently in common fine extents by driving members 21 threadedly engaged with interior screw shafts 20 of planetary gears 19 which are in meshing engagement with a sun gear 18 all for corotation therewith, the sun gear 18 being suitably driven from the exterior. The distal end of each yarn introduction lever 6 is inwardly bent to provide a yarn introduction part 6' which is disposed adjacent to the front end of the outer periphery of the warper drum A.

Designated by B is a fixed creel for supporting a plurality of bobbins on which various yarns 22 of different colors are to be wound respectively. 24 designates a guide plate for guiding the yarns 22 drawn out from the bobbins; 25, a tension regulator for adjusting the tension of the yarns 22; 26, a dropper ring.

F designates a rotary creel (FIG. 15) for supporting two or more bobbins 106 on which various yarns 22 of different colors are to be wound respectively. The rotary creel F is adapted to be substituted for the fixed creel B. 100 designates an encoder for detecting the rotation of the creel; 101, a timing pulley fixed to an output shaft 108 of a reducer; 103, a timing pulley fixed to a rotary shaft 107 and operatively connected with a timing belt 109. 104 designates a tension regulator for adjusting the tension of the yarns 22; 110, a limit switch for sensing any possible yarn breakage. This rotary creel F can operate in synchronism with the yarn introduction parts 6', normally comparing the rotational signals between the above-mentioned encoder 97 and the encoder 100 on the creel. The position of the bobbins to be supported on the rotary creel F must be relatively corresponding to the yarn introduction parts 6'.

Further, 27 designates yarn selection guides for selectively guiding the yarns 22 according to the instructions of a program setting unit 78. 28 designates a slitted plate which generates pulses, in response to the rotation of the pulley 4, to actuate n number of rotary solenoids 29. The selection guides 27 are attached one to each rotary solenoid 29. When the individual rotary solenoid 29 is energized, the corresponding selection guide 27 is angularly moved to advance to its operative position (phantom-line position in FIG. 9); when the rotary solenoid 29 is deenergized, the selection guide 27 is reversely angularly moved to its original position (solid-line position in FIG. 9). S designates a stop plate supported on a base Y via a support T in correspondence with the selection guides 27. When the selection guide 27 is angularly moved to advance to its operative position, the stop plate S receives the distal end portion 27*a* of the selection guide 27 to restrict the movement of selection guide 27. A recess r is formed in the stop plate S at a portion engageable with the distal end portion 27*a* of the selection guide 27. With this recess r, since the distal end portion 27*a* of the selection guide 27 is engageable with the surface of the stop plate S deeper than the usual surface, catching of the yarn during the yarn change by the selection guide 27 can be performed reliably and smoothly. If this recess r did not exist, namely, if the stop plate S were merely supported, the catching of yarns could not have been performed accurately. Thus this recess r would serve to produce very significant results in this invention. The configuration of the recess r may be, for enough, such that the distal end portion 27*a* of the selection guide 27 is brought in engagement with the stop plate S deeply on a rear surface thereof. Alternatively, projections or ridges may be formed on the stop plate S contiguously to such contact surface. Or only the contact surface of the stop plate S may be recessed. In another alternative form, the recess r may be an elongated groove as illustrated. 59*a* designates a guide rod projecting from the inner surface of a lower portion of a yarn introduction cover 59 for guiding a yarn, removed during the yarn changing, so as to move to the lower side of the stop plate S.

30 and 31 designate a pair of guide rods for the yarns 22. 32 designates a yarn removing unit for removing the yarn 22, being wound on the warper drum A, according to the instructions of the program setting unit 78.

33, 34 and 38 designate shedding bars for jointly forming a shed of the yarns 22; two of the bars 33, 38 are upper shedding bars, and the remaining bar 34 is a lower shedding bar. 35 and 37 designate cut shedding bars for separating the shedding down yarns into lower-side yarns and upper-side yarns; one of the bars 35 is a cut shedding up bar, and the other bar is a cut shedding down bar. 39 designates a yarn stop mounted on the drum frame 13 for stopping a yarn immediately under the broken yarn being shedded. The rewinder C is composed of a skelton 40, a pair of rollers 41, 42, a zigzag-shaped comb 43, a roller 44 and a beam 49 for a woven fabric.

Designated by 46 is a main motor, which may be an inverter motor in order to enable, during operation of the warper, the change of speed, the termination of relaxation and the jogging, thus realizing a highly increased winding speed.

47 designates a main speed change pulley; 58, a V belt wound on and between the main speed change pulley 47 and an auxiliary speed change pulley 48; 49, a counter pulley which is coaxial with the auxiliary speed change pulley 48; 50, a brake actuating pinion for reciprocatingly moving a rack to bring the rack into and out of engagement with a brake hole (not shown) in a brake drum D, thus regulating the rotational speed of the warper drum A as desired. 57 designates a belt moving motor (AC servo motor); 52, a shift lever, 53, a driven gear; 54, a sprocket-wheel, 55, a chain; 56, a chain wheel for driving the sun gear 18; 57 and 58, both V belts; 59, a yarn introduction cover.

Additionally, 60 designates a yarn relaxation preventing unit attached to the side wall of one horizontal beam 16*a* or 16*b* under the warper drum A coming close to the yarn selection guide 27. The yarn relaxation prevention unit 60 is preferably located on the horizontal beam 16*a* which is disposed at the lowermost surface of the warper drum A; but it may be located at the horizontal beam 16*b* next to the horizontal beam 16*a* , which performs the same functions. 61 designates a bracket, by means of which the yarn relaxation preventing unit 60 is attached to the side wall of the horizontal beam 16*a*. 62 designates a rotary disk constituting the yarn relaxation preventing unit 60. The rotary disk 62 has a yarn pressing cutaway 63 formed by cutting away about a quarter of the entire circumference of the disk 62 and is normally urged to rotate in one direction by a spiral-shaped restoring spring means 64. 65 designates a stop projecting from the metal fitting 61 and engageable with the end surface of the yarn pressing cutaway 63 to restrict the rotation of the rotary disk 62; this stop 65 serves to hold a removed yarn 22 in cooperation with the end surface of the yarn pressing cutaway 63. 66 designates a rotary solenoid attached to the bracket 61; the rotary solenoid 66 is operable, when energized, to render the rotary disk 62 in the reverse direction. 67*a*, 67*b* and 67*c* are sensors for detecting the passing of the slit 28*a* of the slitted plate 28. The slit 28*a* is designed so as to rotate in synchronism with the yarn introduction lever 6; the sensors 67*a*, 67*b*, 67*c* detects also the rotation of the yarn introduction lever 6 by detecting the rotation of the rotation of the slit 28*a*. These three sensors 67*a*, 67*b*, 67*c* are arranged at an angular space of about 120°. Of these three sensors, the sensor 67*b* is located adjacent to the lower side of the slitted plate 28 so as to detect whether the yarn introduction lever 6 has passed the yarn relaxation prevention unit 60. Now when the yarn to be removed next passes the yarn relaxation preventing unit 60 during the winding, the rotary solenoid 66 is energized by a signal from the program setting unit 78. Then when the yarn introduction lever 6, i.e., the slit 28*a* passes the sensor 67*a* spaced from the sensor 67*b* by about 240° in the direction of rotation, the rotary solenoid 66 is deenergized by a signal from the program setting unit 78. 68 designates a cover attaching groove formed in the lower portion of the side wall of the horizontal beam 16, in which groove a cover for preventing any dust from entering the warper drum A is to be attached In FIG. 4, 69 designates a movement/stopping change-over lever for changing over the movement/stopping of the conveyor belt 17; 70, a locking lever for locking the warper drum A; 74, a shedding bar adjusting lever; 75, a shedding bar locking handle; 79, a controller; 80, a yarn tensioning unit located centrally on the straight part 12 of the warper drum A.

In FIG. 1, 87 designates an upper limit switch mounted on the upper portion of the fixed creel B and operable each and every time the yarn 22 is wound round the warper drum A. While the yarn 22 is being wound on the warper drum A as the yarn introduction lever 6 is in rotation, this upper limit switch 87 is switched on by the yarn 22 being supplied. While the yarn introduction lever 6 is in rotation even as the yarn 22 is not wound on the warper drum A, namely, when there occurs a mischange, the upper limit switch 87 remains off, never being switched off. Utilizing the above-mentioned operation of the upper limit switch 87, confirmation is made whether the upper limit switch 87 is switched on/off each and every time the yarn 22 is wound around the warper drum A; when the upper limit switch 87 is never switched on even once as the yarn 22 makes a single turn around the warp drum A, the operation of the electrically controlled sample warper W is automatically terminated so that any inconvenience due to the mischange can be avoided.

Designated by 88 is a lower limit switch located under the dropper ring 26; when the yarn 22 is broken off, the dropper ring 26 falls to switch the lower limit switch 88 off. Upon receipt of a signal from this lower limit switch 88, the operation of the sample warper W is terminated so that any inconvenience due to the yarn breaking can be avoided.

Figure 15:
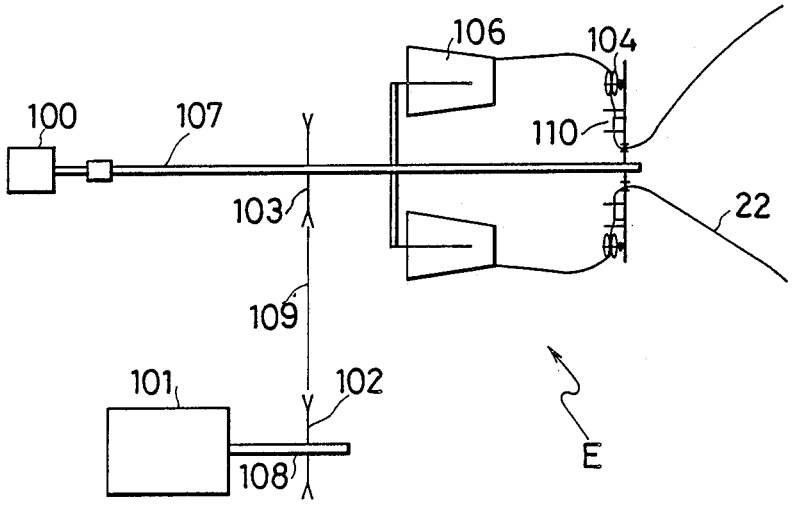
FIG. 15 is a view showing a rotary creel.

In FIG. 15, 110 designates another limit switch for detecting any yarn breaking of the rotary creel to terminate the sample warper W in the similar manner.

Figure 16:
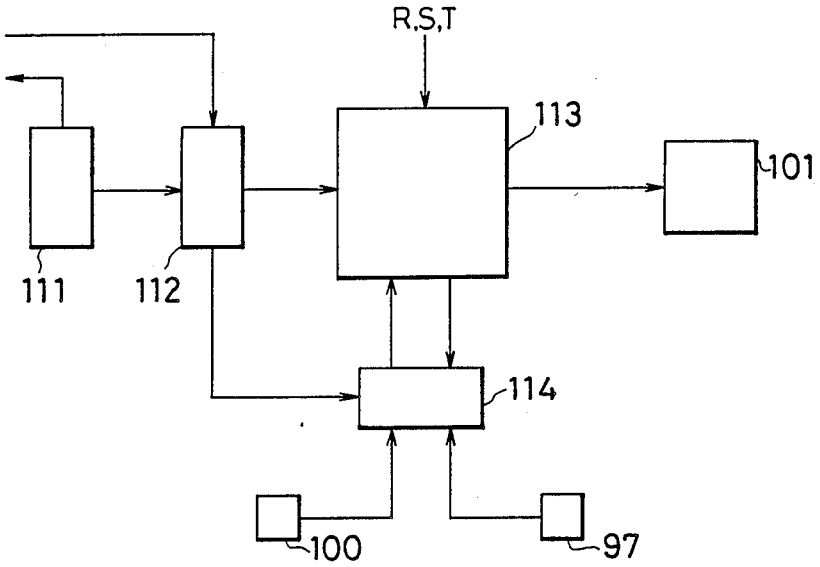
FIG. 16 is a block diagram showing the principle of operation of the rotary creel.
Figure 17:
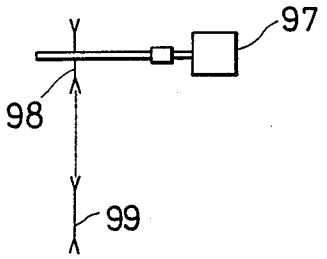
FIG. 17 is a view showing the manner in which an encoder of the sample warper is attached.

FIG. 16 shows the principle of operation of the rotary creel 110 of FIG. 15. In FIG. 16, an operating switch assembly 111 is composed of four switches for warping on, warping off, fine movement in forward rotation, and fine movement in reverse rotation, respectively. Of such four switch signals, the switch signals for warping on and warping off are transmitted to the electronically controlled sample warper W, while the switch signals for fine movement in forward rotation and fine movement in reverse rotation are transmitted to a synchronous operation control unit 112 to locate the yarn introduction part 6' and the bobbins 106 (on which the yarn 22 to be caught by the yarn introduction part 6' are wound) in register with one another. In the synchronous operation control unit 112, a RUN signal (warping-on signal), a JOG signal (jogging operation signal), which are transmitted from the sample warper W, and the above-mentioned fine-movement-in-forward-rotation signal and fine-movement-in-reverse-rotation signal are converted into ENB signals (synchronous operation enable signal) to be transmitted to an inverter 113. Further, to an synchronous operation card 114, an encoder 97 mounted in the warper W and an encoder 100 mounted in the rotary creel F are connected. During the jogging operation when the warping is on, the rotational angles of the two encoders 97, 100 are normally compared, and the signals are transferred between the synchronous operation card 114 and the inverter 113 so as to keep the positional relation between the yarn introduction part 6' and the bobbins 106 (on which the yarns 22 to be caught by the yarn introduction part 6' are wound) constant. The inverter 113 gives a rotation signal to a reducered motor 101 located in the rotary creel F. The inverter 113 and the synchronous operation card 114 may be of the type on the market.

The operation of the above-described electronically controlled sample warper W will now be described.

Firstly, the yarns 22 are different in number depending on the pattern or design of a sample. Bobbins on which various yarns of n number of colors, for example, are wound respectively are supported on the fixed creel B. A desired number of yarns 22 are drawn out from the bobbins and are threaded through the guide plate 24, the tension regulator 25, the dropper ring 26 and the selection guide 27 and are pressed against the base Y by a yarn fastener E with permanent magnet. Thus the yarns 22 have been set.

Then concurrently with the operation of the warper W according to a prepared arrangement preset by the program setting unit 78, the yarn introduction part 6' takes a circular motion over and round the warper drum A to thereby wind the yarns 22 over the conveyor belts 17. At that time the conveyor belts 17 also are moved in the direction of an arrow (rightwardly in FIG. 1) by the action of the interior screw shaft 20. As the pulley 4 is rotated, pulses are produced by the slitted plate 28 to render the n number of rotary solenoids 29 operative. When the selection guide 27 attached to the rotary solenoid 29 are advanced to its operative position, the yarn 22 having been tensioned between a pair of guide rods 30, 31 is caught by the yarn introduction part 6' and is thereby wound around the conveyor belts 17. According to the next instructions of the program setting unit 78, the yarns 22 being wound is removed by the action of the yarn removing unit 32, and then another yarn is wound on the conveyor belts 17 according to the next to next instructions of the program setting unit 78.

Figure 9:
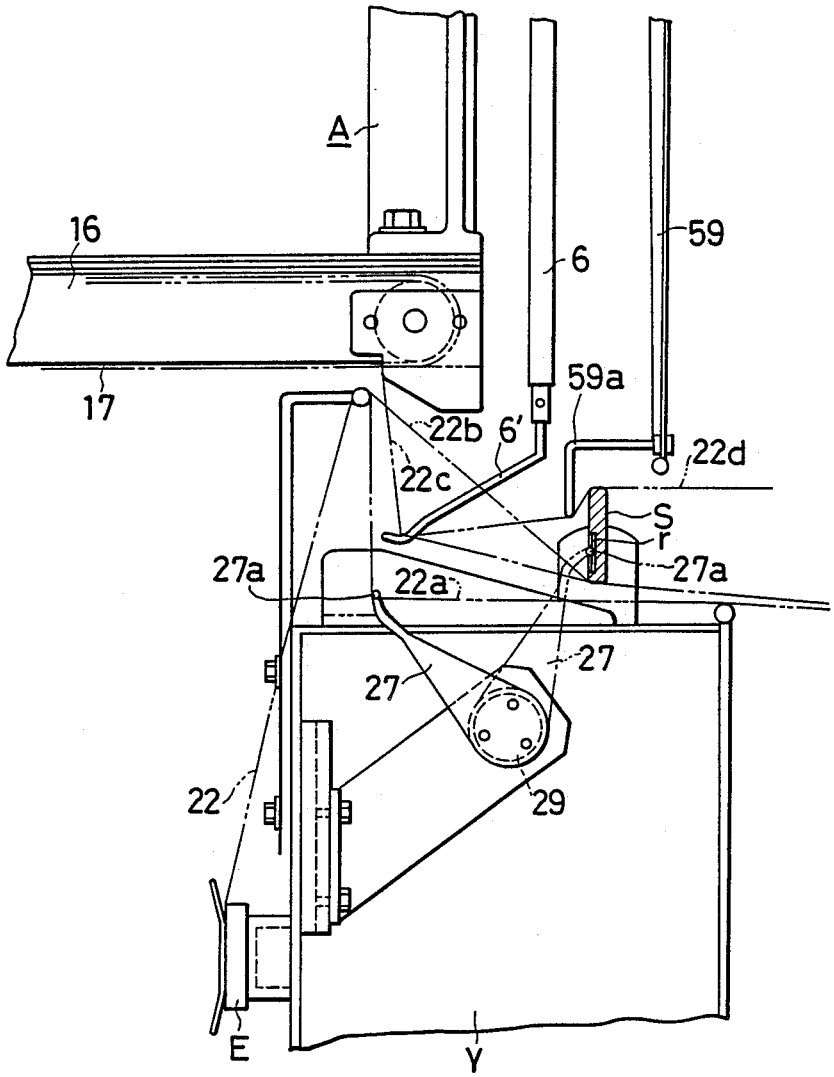
FIG. 9 is a view showing a yarn selection guide.

The movements of the yarn 22 during the yarn changing will now be described with reference to FIG. 9. The yarn **22*a* caught by the selection guide 27 initially located in the original position assumes its position 22*b* as the selection guide 27 is pivotally moved to advance to its operative position. From this position, the yarn 22*b* is wound round the warper drum A by the yarn introduction part 6'; 22*c* designates the posture in which the yarn 22 is wound one turn, and 22*d* designates the posture in which the yarn is wound two or more turns. When the yarn 22*d* wound on the warper drum A is removed therefrom by the yarn removing unit 32, the yarn assumes again its posture 22*b*. Because the distal end 27*a* of the selection guide 27 is located in the recess r of the stop plate S as the selection guide 27 is angularly moved to advance to its operative position to catch the removed yarn 22*b*, the selection guide 27 can catch the removed yarn 22*b*** smoothly and reliably, thus avoiding accidents such as a double winding.

At that time, as the yarn 22 to be removed and thus the yarn introduction lever 6 has passed the yarn relaxation preventing unit 60, the sensor **67*b* makes an immediate detection so that the rotary solenoid 66 is energized by a signal from the program setting unit 78 and the controller 79. Upon its energization, the rotary solenoid 66 causes the rotary disk 62 to rotate in a direction against the bias of the spring means 64 so that the yarn located in the yarn pressing cutaway 63 is pressed by the end surface of the yarn pressing cutaway 63 and the stop 65. This pressing continues for only a short time, namely, until the yarn introduction lever 6 reaches the position of the sensor 63*a*, whereupon the yarn relaxation preventing unit 60** stands by for the next possible removal of the yarn.

Upon termination of the yarn pressing by the rotary disk 62, the yarn selection guide 27 is returned to its original position with keeping this removed yarn taut due to the weight of the dropper ring 26, and then the yarn selection guide 27 waits for the next instructions of the program setting unit 78 to make windings of the yarn in order in a predetermined arrangement.

For using the rotary creel F, since the yarn exchanging step can be omitted, the power source of the programing setting unit 78 is switched off so that the rotary solenoid 29, the yarn removing unit 32 and the yarn relaxation preventing unit 60 are kept inoperative. The moving rate of the conveyor belt 17 and the counting operation of the total yarns counter will vary depending on the number of yarns concurrently wound on the warper drum A.

During the winding, the shedding bars 33, 34, 38 make the shedding operation, and the cut shedding bars 35, 37 divide the shedded yarns into a lower group of the yarns and an upper group of the yarns. In the wound-up yarns, the shedded yarns are cut by the action of the cut shedding bars 35, 37, and the lower group of yarns are stopped by the yarn stop 39 mounted on the drum frame 13, while the upper group of the yarns are led to a fabric round the skelton 40 of a rewinding unit C and then are wound thereround via the roller 41. Thereafter the yarns may be taken up, from the roller 42, onto the beam 49 for woven fabric via the roller 42, the zigzag-shaped comb 43 and the roller 44 without any difficulty.

The operation of the electronically controlled sample warper of this invention will now be described with reference to FIGS. 10*a*, 10*b*, . . . 10*l*. The program is adapted for performing a parallel processing in which successive routines of FIGS. 10*a* through 10*l* are repeated at intervals of from about 0.5 to 1 millisecond.

When the rotary creel F is in use, two of the yarn introduction part 6' are preferably located with their mutual angular displacement of 180° so that the yarn introduction part 6' catching the yarn firstly wound around the warper drum A is the one aligned with the slit 28*a* of the slitted plate 29. The yarn introduction part 6' to be used when the rotary creel F is not in use is only this yarn introduction part 6'. The second yarn when the rotary creel F is in use is catched by the yarn introduction part 6' that is angularlty displaced by 180°.

Figure 10A:
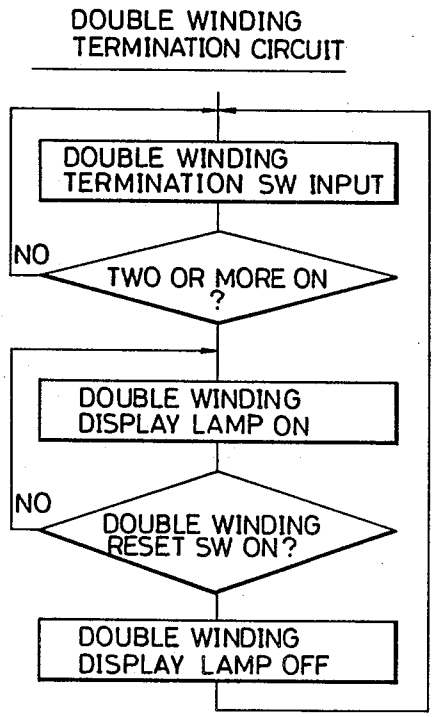
FIGS. 10*a*–10, 10*b'*, 10*c'* and 10*l'* are flowcharts of motions of various means of the warper.

Double Winding Termination Circuit (FIG. 10*a*)

Figure 3:
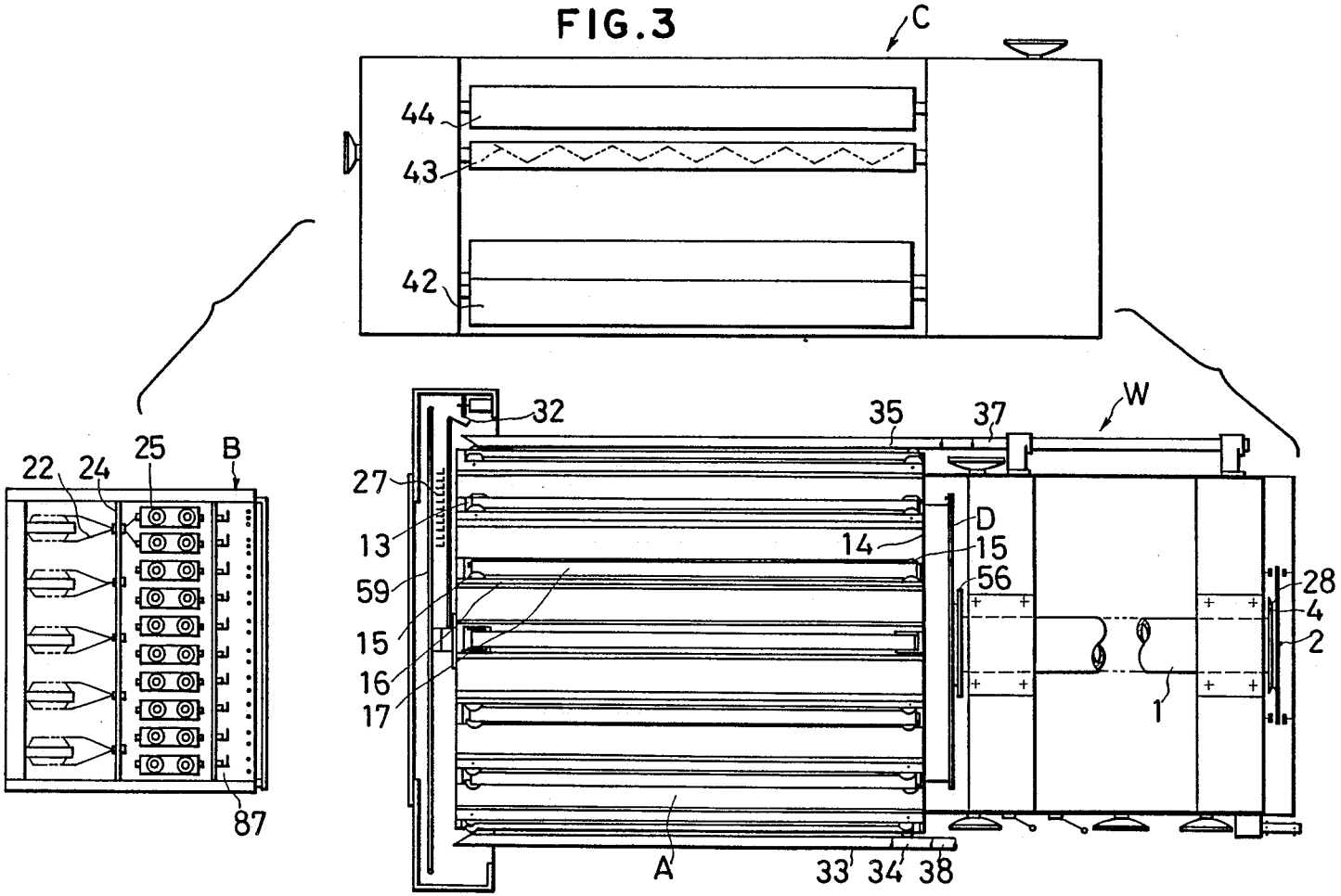
FIG. 3 is a plan view showing the arrangement of the sample warper, the fixed creel and the rewinder.
Figure 4:
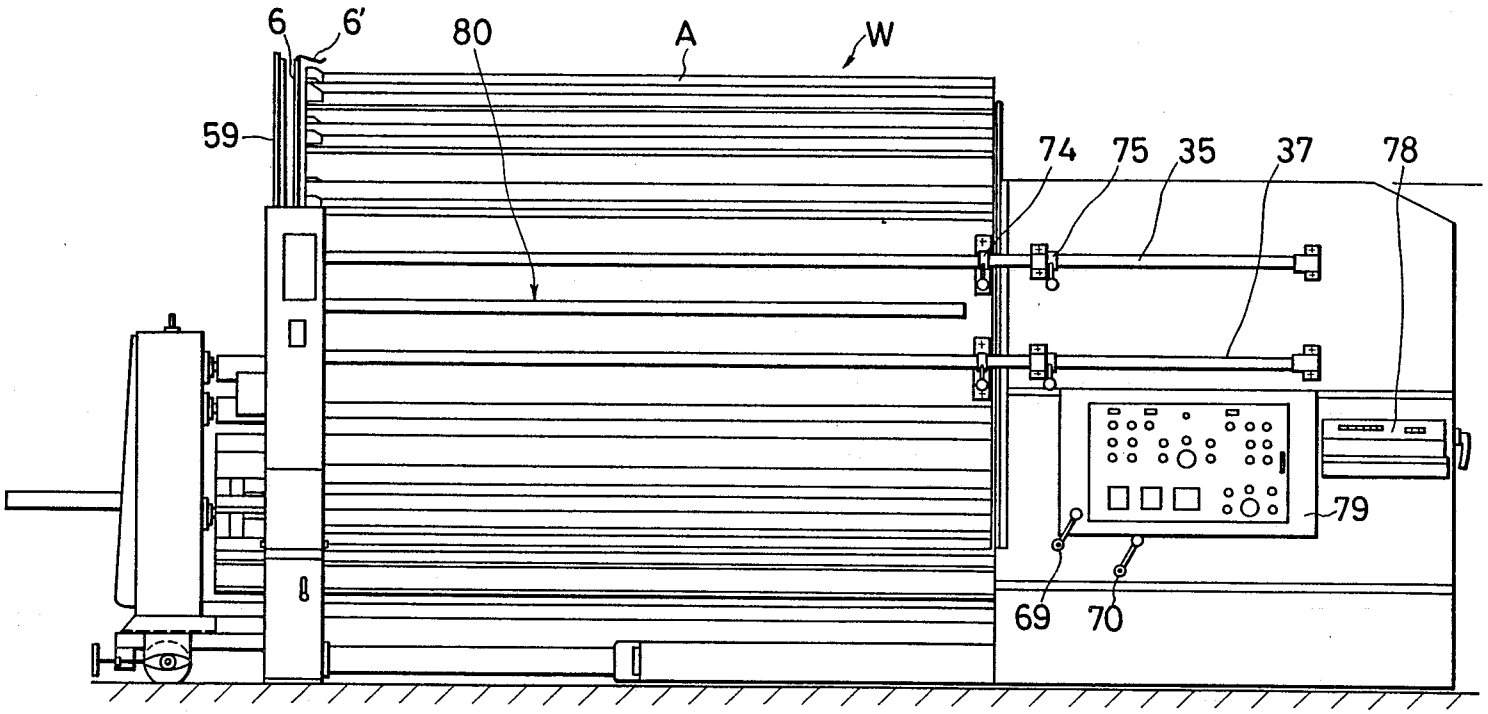
FIG. 4 is a side elevational view of the sample warper.
Figure 5:
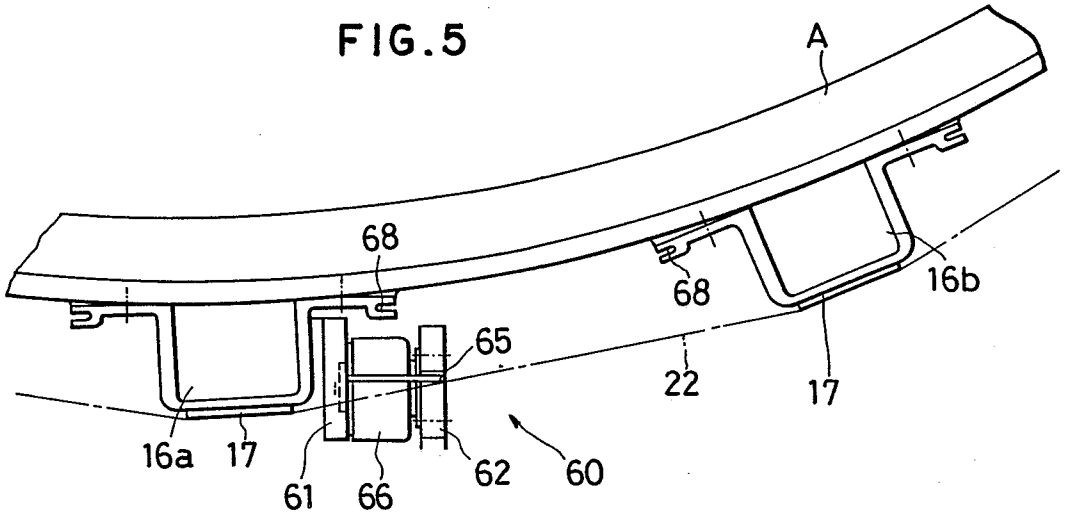
FIG. 5 is a fragmentary side view of a yarn relaxation prevention unit.
Figure 6:
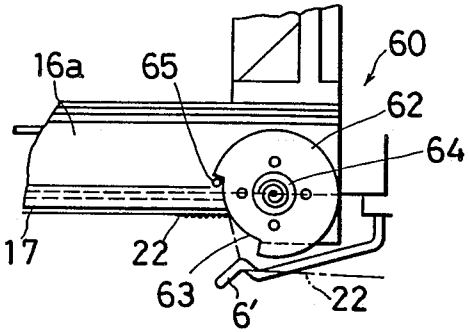
FIG. 6 is a detail front view of FIG. 5.
Figure 7:
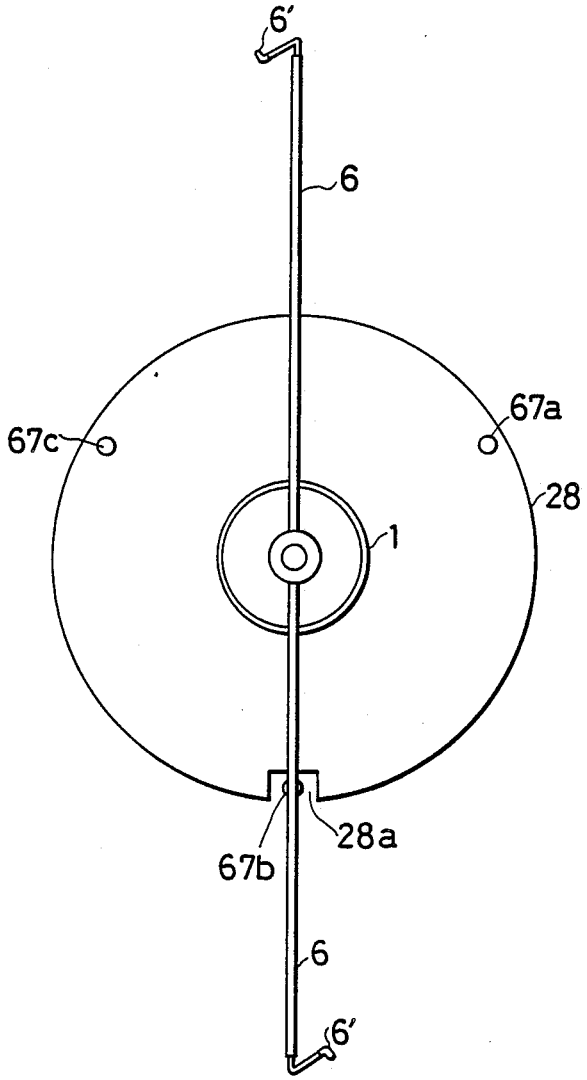
FIG. 7 is a view showing the arrangement of a yarn introduction lever and a slitted plate.
Figure 8:
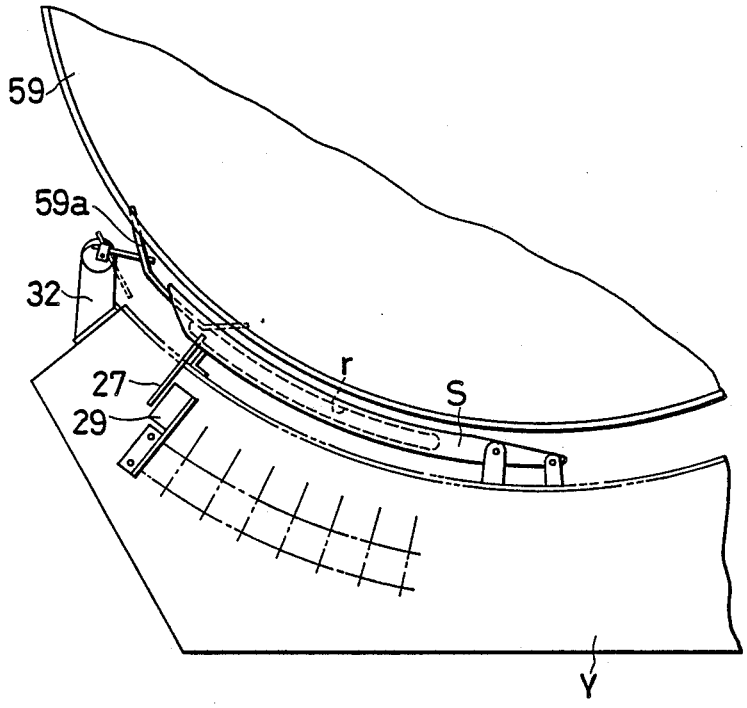
FIG. 8 is a view showing the manner in which the stop plate is attached.

The double winding detecting sensors, namely, the upper limit switches 87 are supported on a creel stand for the yarn supply (FIG. 3). There are n number of sensors one for each yarn supplied. The individual sensor 87 issues an output when the yarn 22 is wound on the warper drum A by the yarn introduction part 6'. As the two or move yarns are concurrently caught by the yarn introduction part 6' due to the accident during the yarn selecting, the output of the sensor 87 turns the double winding display lamp on. This output signal is combined circuitwise with the warper termination switch SW to terminate the warper. The releasing is made by a double winding reset switch.

Since the fixed creel stand B is not used when the rotary creel F is to be used, this double winding termination circuit is kept free from operating.

Shedding Circuit (when the creel stand for fixed yarn supply is in use) (FIG. 10*b*)

The shedding bar assembly is composed of four kinds of shedding bars, i.e., shedding up bars 33, 38, a shedding down bar 34, a cut shedding up bar 35, and a cut shedding down bar 37. The solenoids are connected one to each of the shedding bars; by the actions of the individual solenoids, the yarns to be wound on the warper drum A are brought selectively upwardly and downwardly of the individual shedding bar to make a shedding and a cut shedding. The shedding at the start can be selected by the shedding up switch and the shedding down switch.

In the shedding method while the yarn is not being exchanged, if the warper is in operation and also if the count value "0" (winding turns display is "0") is confirmed, the three kinds of solenoids, namely, the shedding up solenoid, the cut shedding up solenoid and the cut shedding down solenoid are switched on, and are switched off by the photocell C (67*c*). Concurrently, the shedding down display lamp is switched on. As the count is "0" (winding turns display is "0"), the three kinds of solenoids, namely, the shedding down solenoid, the cut shedding up solenoid and the cut shedding down solenoid are switched on, and are switched off by the photocell C (67*c*). At the same time, the shedding up display lamp is turned on. Upon the next count "0" (winding turns display is "0"), the foregoing procedures are repeated.

Thus in the shedding method while the yarn is not being exchanged, the individual solenoid moves one over rotation (during the yarn changing) than the operating time of each solenoid during the shedding while the yarn is not being exchanged.

Shedding Circuit (when the rotary creel is in use) (FIG. 10*b'*)

A discrimination is made on whether the first yarn to be first wound on the warper drum A begins with the shedding up (hereinafter called "shedding up mode") or with the shedding down (hereinafter called "shedding down mode"). If it starts with the shedding up mode, the shedding up display lamp is turned on; if it starts with the shedding down mode, the shedding down display lamp is turned on. Then if the warper is in operation and also if it is confirmed that the count value is "0" (winding turns display is "0"), the shedding up solenoid is on in the shedding up mode. Or the shedding down solenoid is on in the shedding down mode. When the photocell B (67*b*) is turned on, the shedding up solenoid and the shedding down solenoid are off and on, respectively, in the shedding up mode. Or the shedding down solenoid and the shedding up solenoid is off and on, respectively, in the shedding down mode. In either shedding mode, the cut shedding up solenoid and the cut shedding down solenoid are both on. Subsequently, when the photocell C (67*c*) is on, the shedding up solenoid and the shedding down solenoid are both off in either shedding mode, whereupon when the photocell B (67*b*) is on, the four solenoids are all off. The foregoing procedures are repeated.

Figure 10C:
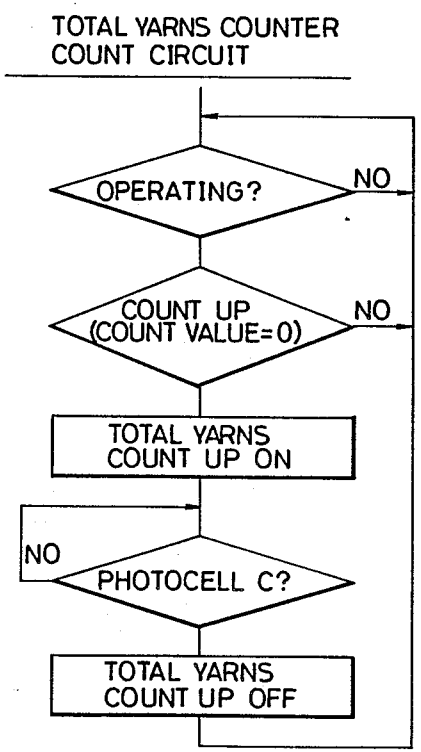

Total Yarns Counter Count Circuit (when the creel stand for fixed yarn is in use) (FIG. 10*c*)

In the circuit in which the up signal of the total yarns counter is on/off, if this counter is reset at the count value "0" (winding turns display is "0"), the up signal of the total yarns counter will be on, and will be off by the photocell C (67*c*) to proceed the total yarns counter. This is true because two yarns at a time are wound on the warper drum A.

Figure 10D:
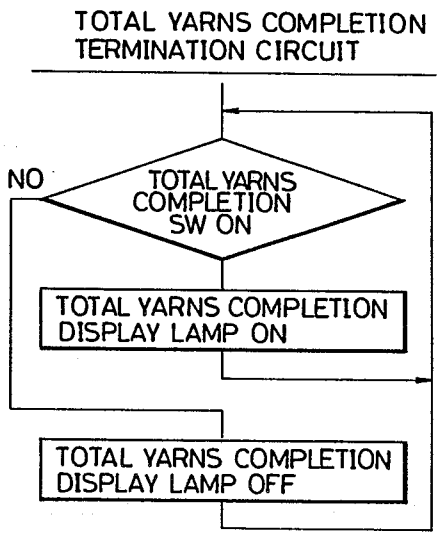
Figure 10E:
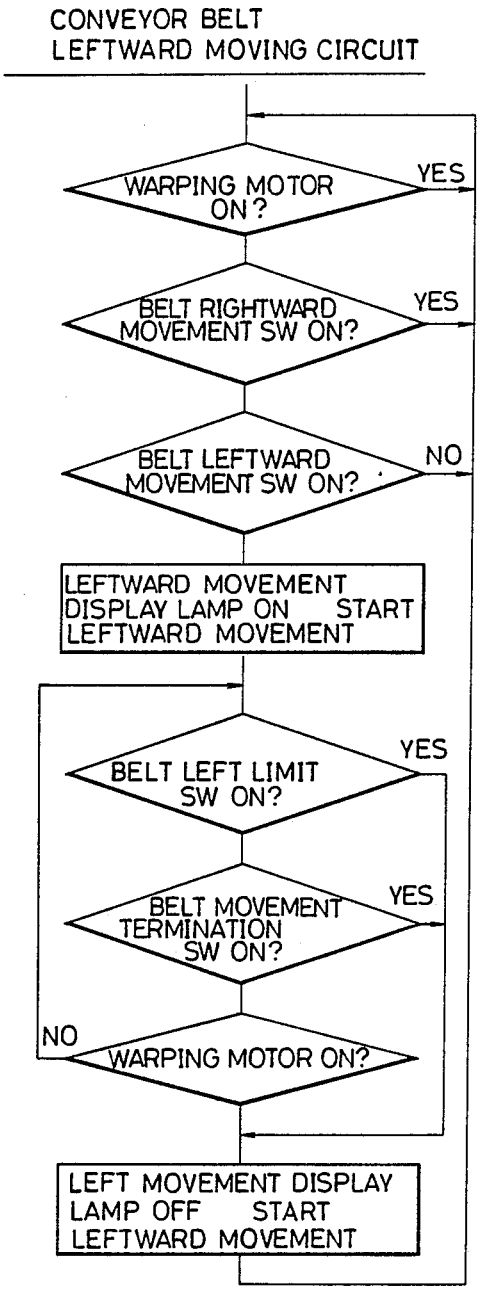

Total Yarns Completion Termination Circuit (FIG. 10*d*)

When the counted results of the total yarns counter reaches a preset value, the total yarns completion display lamp is turned on. Since this on signal of the total yarns completion display lamp is combined circuitwise with the warper termination switch, the warper is terminated. Releasing is performed by the reset switch of the total yarns counter.

Figure 10F:
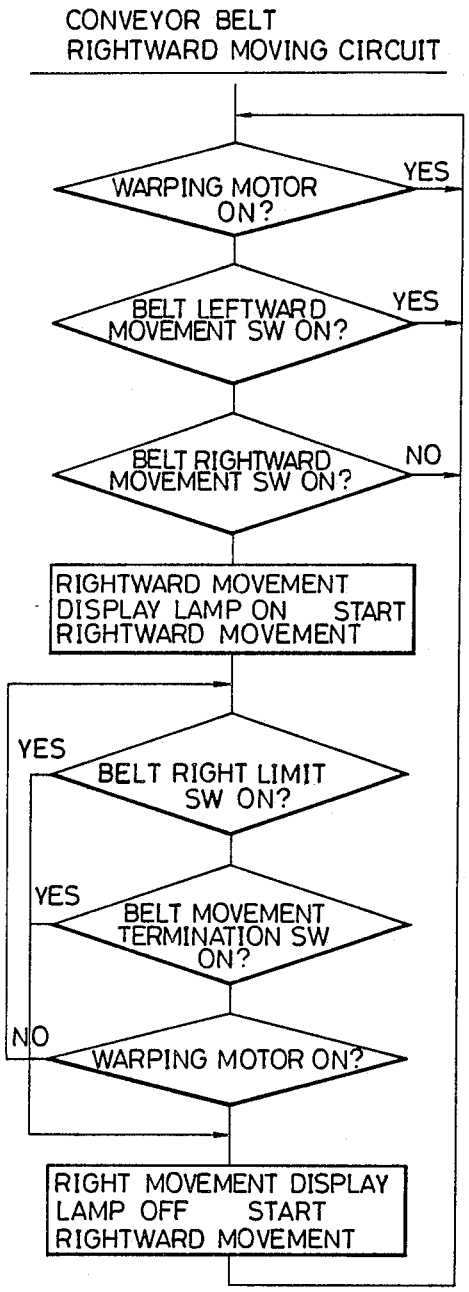

Conveyor Belt Leftward Moving Circuit (FIG. 10*e*) and Conveyor Belt Rightward Moving Circuit (FIG. 10*f*)

Since the conveyor belt of the sample warper of this invention is not endless and is movable leftwardly and rightwardly, the conveyor belt can be moved independently by the leftward moving switch and the rightward moving switch to be located with the start position and with the rewinding position. For safety, a belt right limit switch and a belt left limit switch are located at the right and left limits, respectively. When the left limit switch is actuated during the leftward movement of the conveyor belt 17, the conveyor belt 17 is stopped. Likewise, when the right limit switch is actuated during the rightward movement of the conveyor belt 17, the conveyor belt 17 is stopped.

Figure 10G:
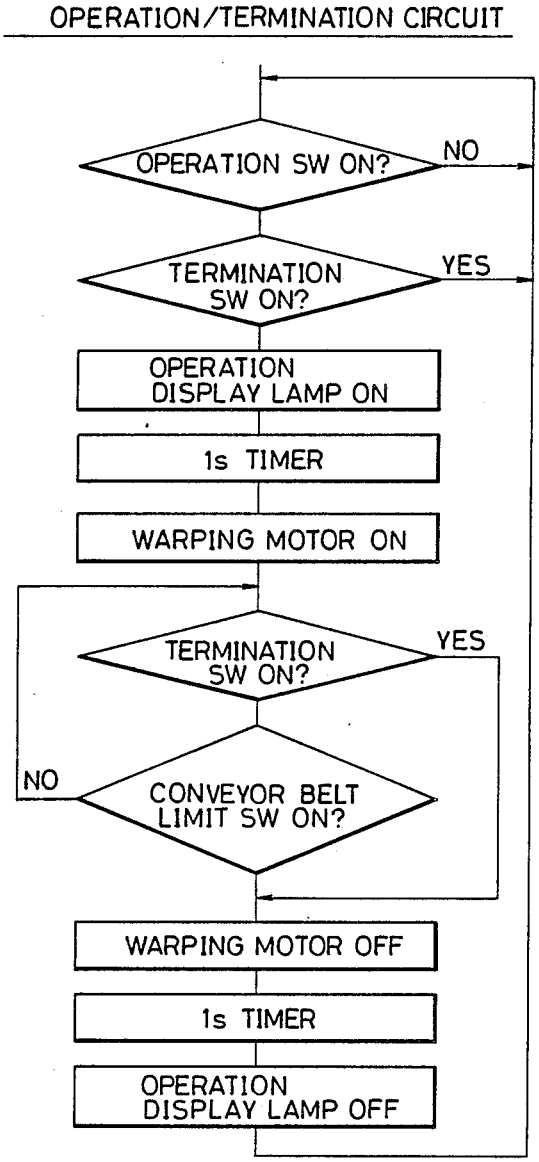

Operation/Termination Circuit (FIG. 10*g*)

This circuit transmits rotation of the main motor 46 to the yarn introduction lever 6. After both the operation switch and termination switch are switched on, a one-second timer is inserted to take a synchronism with a part of program which part discriminates whether it is operating when it is either operated or terminated.

Figure 10H:
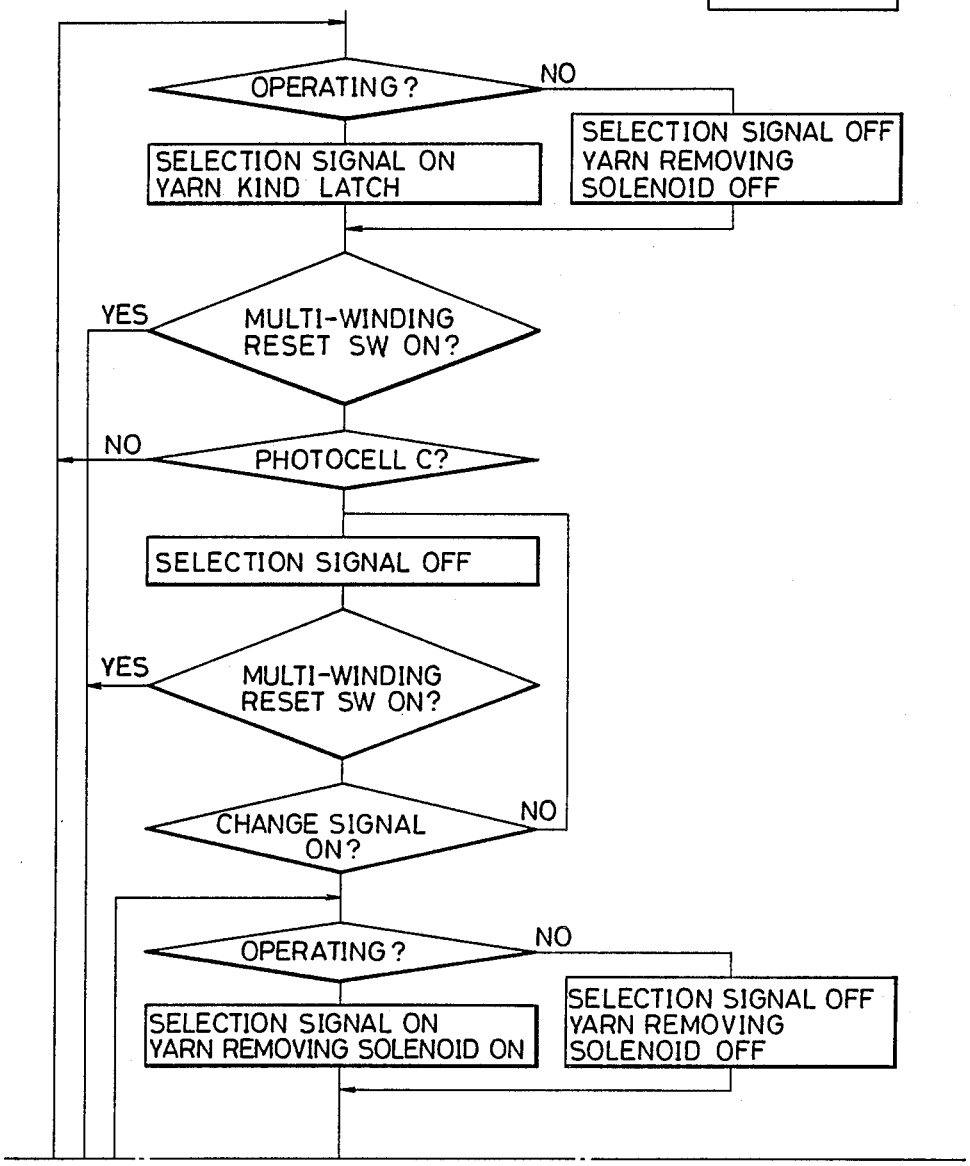

Yarn Section Circuit (FIG. 10*h*)

This circuit controls the yarn selection and the yarn removing solenoids.

Figure 10I:
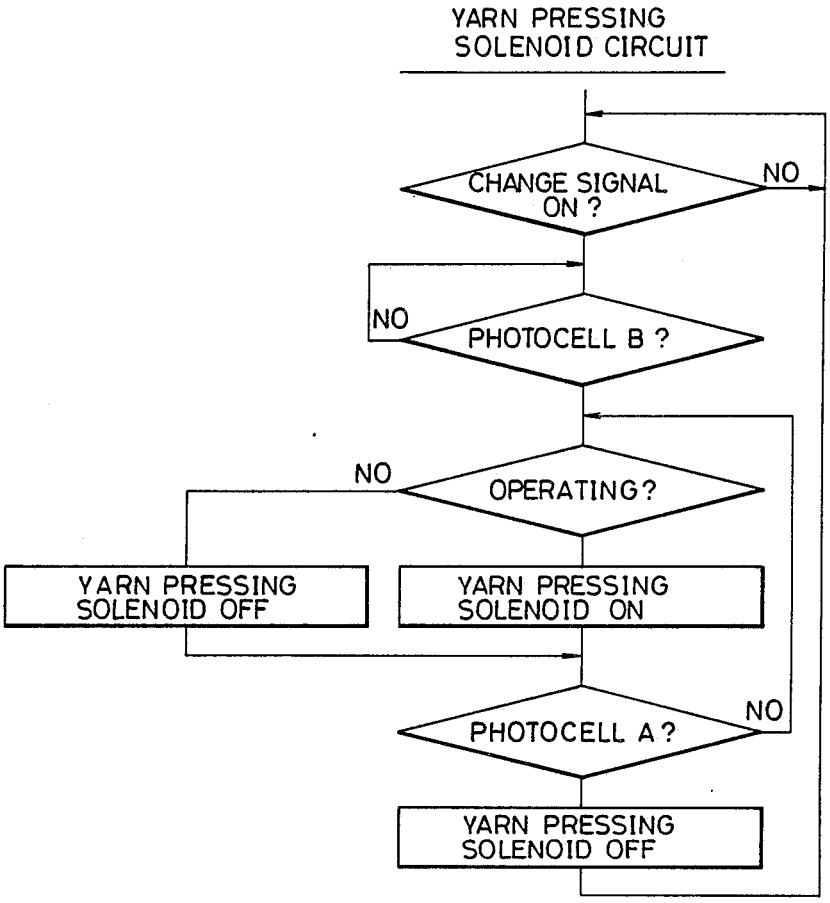

Yarn Pressing Solenoid Circuit (FIG. 10*i*)

This circuit is operable to render the yarn pressing solenoid operative/inoperative. After the change signal for yarn selection is on, the yarn pressing solenoid will be rendered operative only from the photocell B (67*b*) to the photocell A (67*a*).

Figure 10J:
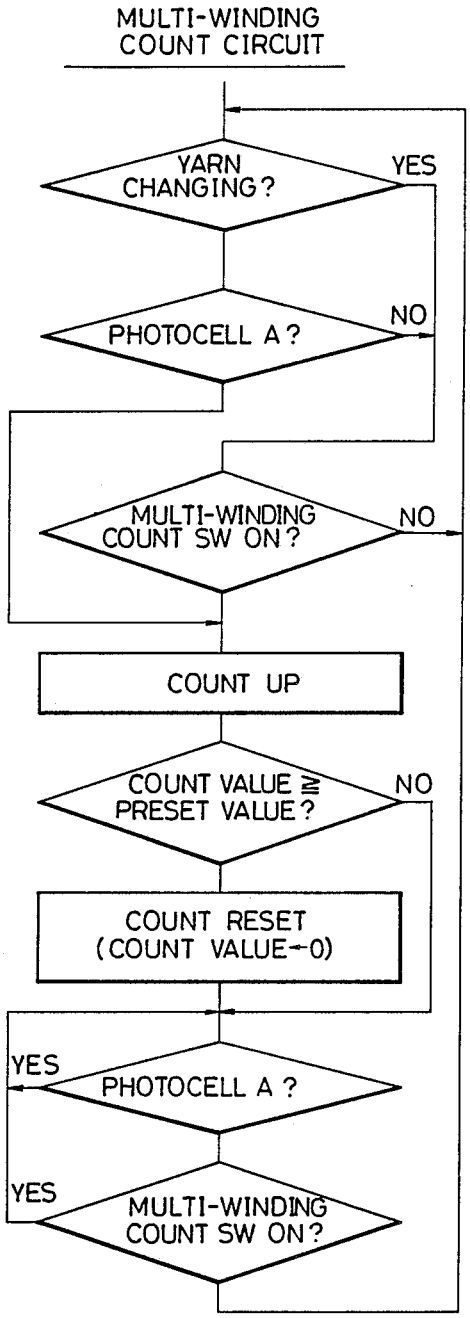

Multi-Winding Count Circuit (FIG. 10*j*)

This circuit counts the number of yarn windings on the warper drum A and displays the count value. The multi-winding count display takes one up by the output of the photocell A outside the duration of the yarn section; as the count value becomes over a preset value of windings, the mult-winding display will be "0".

Figure 10K:
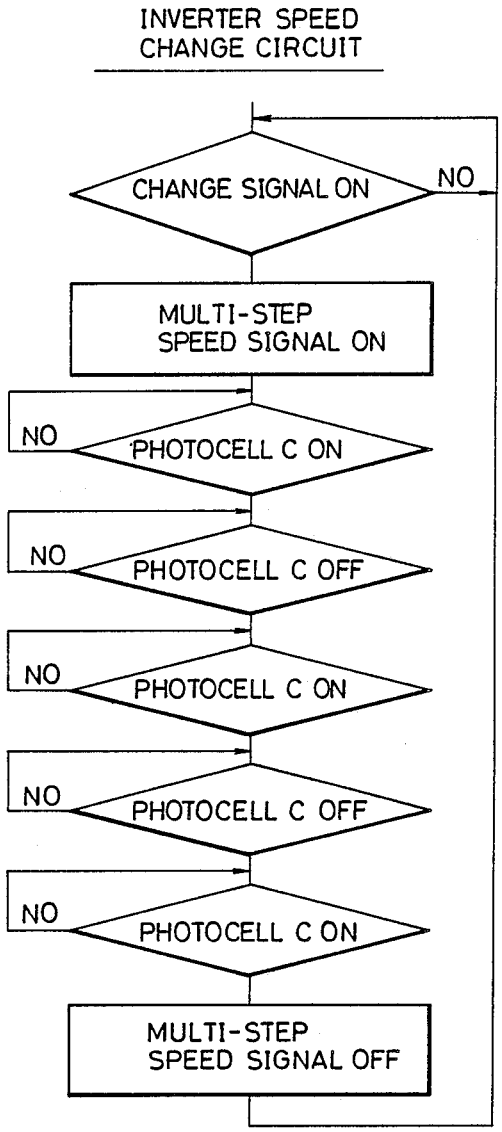
Figure 10:
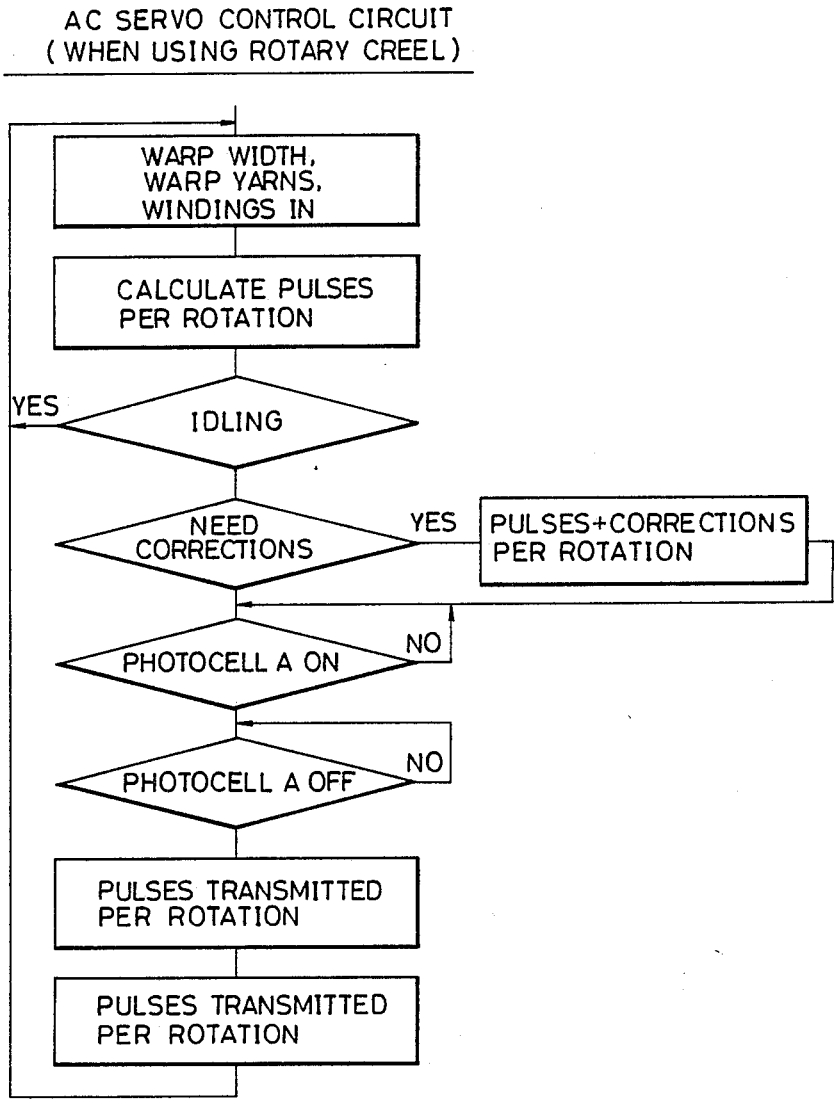
Figure 10B:
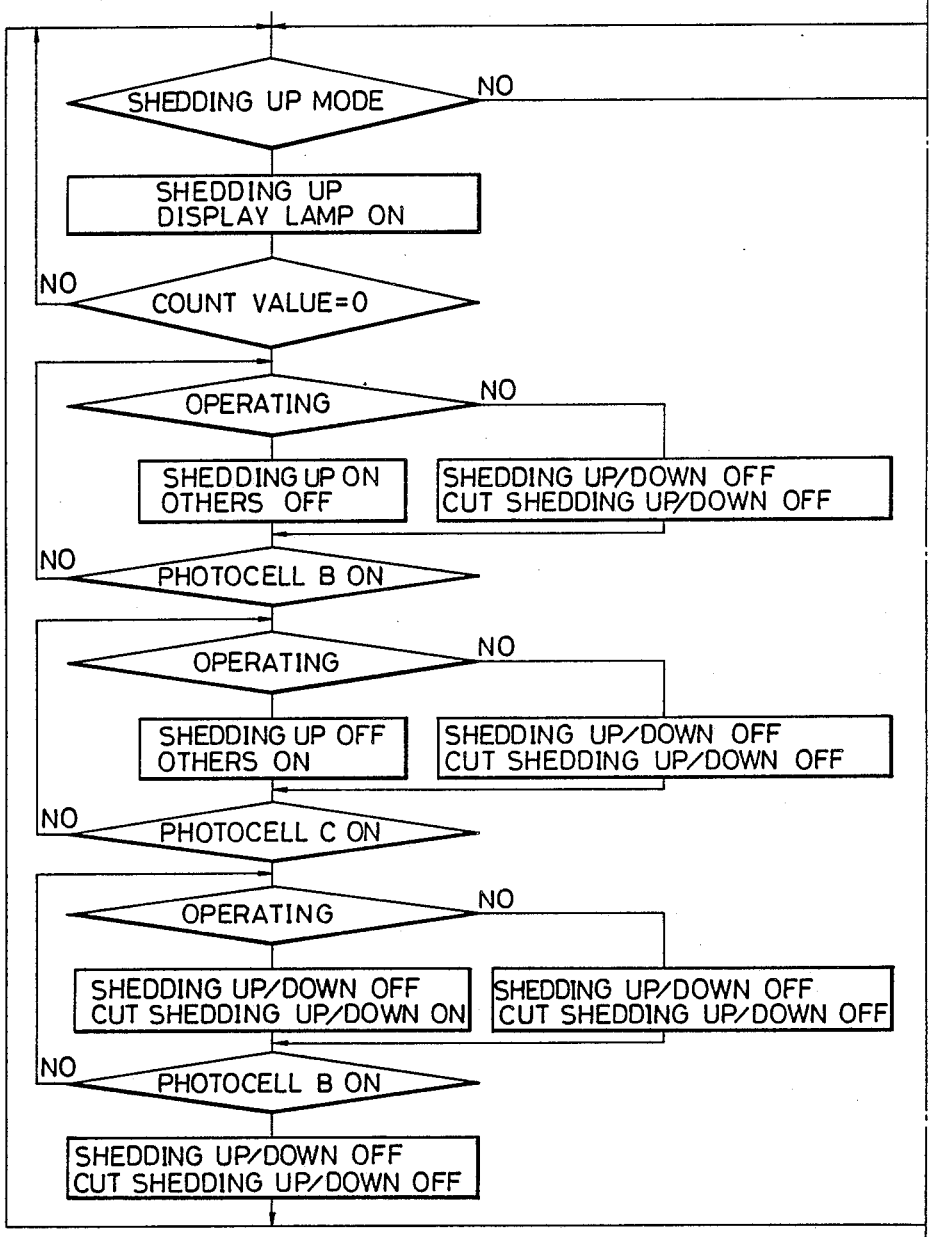
Figure 10C:
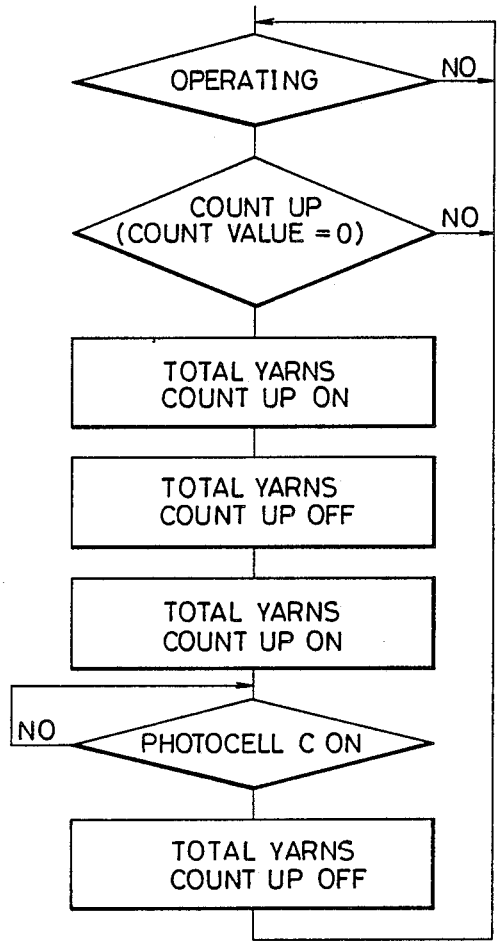

Inverter Speed Change Circuit (FIG. 10*k*)

Here the "inverter" drives the main motor 46 in the sample warper W and is not an inverter attached to the rotary creel. This circuit discriminates whether the change signal outputted from the program setting unit 78 in synchronism with the photocell A (67*a*) during the yarn changing is on and renders a multi-step speed change signal (low speed signal) to be on to rotate the main motor 46 at a low speed. Then, confirming on/off signal of the photocell C (67*c*), the circuit sets the number of idling rotations, during which time the multi-step speed change signal (low speed signal) is continues to be on. When it is released out of the idling rotation, the circuit renders the multi-step speed change signal to be off to rotate the main motor 46 at a high speed. Thereafter, the foregoing procedures are repeated. The flowchart shows the example in which two idling rotations are made.

Figure 10L:
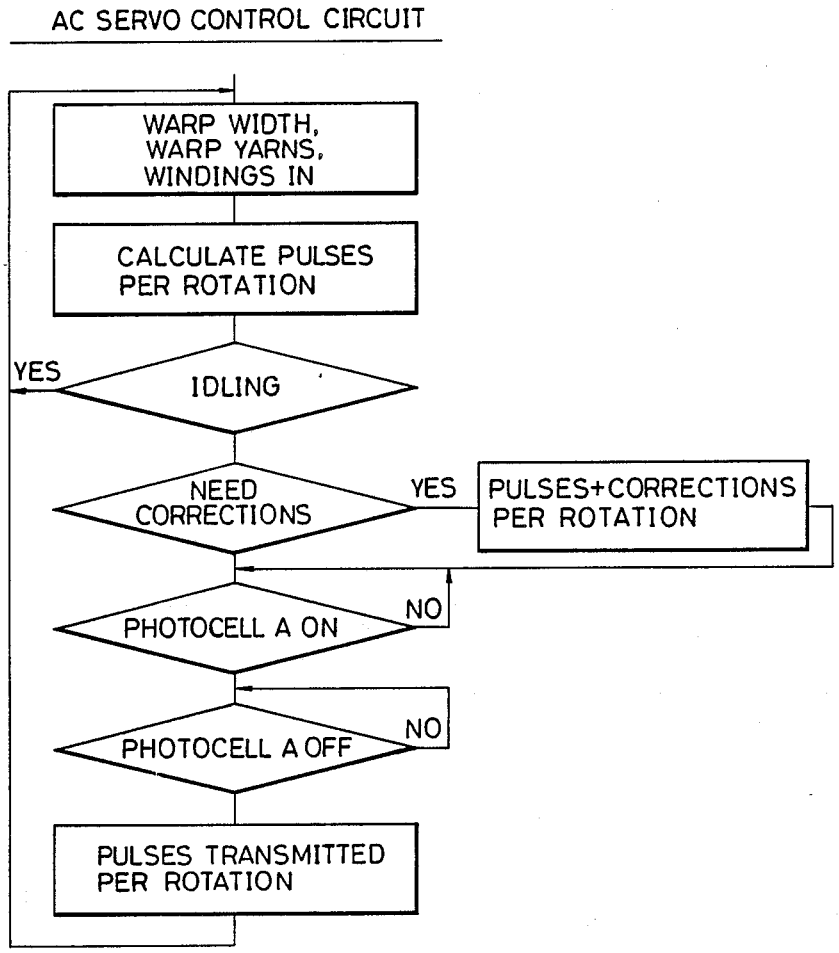

AC Servo Control Circuit (when the fixed creel stand for yarn supply is in use) (FIG. 10*l*)

This circuit reads the warp width, the number of warp yarns, and the number of yarn windings from a warp length setting unit 90 and a number-of-windings setting unit RS1 and calculates the number of feed pulses per winding (provided that the AC servo motor is driven by the input of the number of pulses). The circuit also calculates a corrected number if correction is necessary. Then a discrimination is made on whether it is in idling rotation or not; if it is in idling rotation, the control routine returns to the start and does not advance. If it is not in idling rotation, the circuit discriminates the on/off signal of the photocell A (67*a*) and issues the calculated number of pulses to rotate the conveyor belt motor 51 to turn through an angle corresponding to the calculated number of pulses. The foregoing procedures are repeated.

AC Servo Control Circuit (when the rotary creel is in use) (FIG. 10*l'*)

The only difference from when the fixed creel stand is in use is that to wind two yarns at a time on the warper drum A, transmission of number of the pulses are repeated twice. Other procedures are identical with those when the fixed creel stand is in use.

Description will now be made on a practical example in which winding of alternately two red yarns and two white yarns are repeated up to the total number of 3,600 and the warp width of 100 cm with the double warp length (multi-winding), the creel stand for fixed yarn supply being used.

Firstly, the red yarn and the white yarn are set on the creel stand B and are threaded through the guide plate 24, the tension regulator 25, and the dropper ring 26. The red yarn is threaded through No. 0 guide of the selection guide 27, and the white yarn is threaded through the No. 1 guide. Then the red and white yarns are pressed against the base Y by the yarn fastener E with the permanent magnet.

Secondly, a program is prepared according to the yarn setting of the selection guide 27. The display of the programmed contents is as follows:

| Address | Yarn Kind | Number of Yarns | Number of repeats |
|---|---|---|---|
| 000 | 0 | 002 | 000 |
| 001 | 1 | 002 | 000 |

At the same time, the number of multi-windings (e.g., 2) and the amount of movement of the conveyor belt (e.g., 100 cm when the total number of yarns reaches 3,600) are set. 3,600 is set in the total yarns counter.

As the yarn introduction lever 6 is angularly moved when the operation switch is switched on, the slitted plate 28 also is angularly moved in the same rotational speed, and at the same time, the conveyor belt 17 is moved a preset distance at a time from the front side to the rear side.

Then as the warper motor (main motor) 46 is rotated to locate the yarn introduction lever 6 at the start position between the photocell A (67*a*) and the photocell B (67*b*) and as the operation switch is switched on, the solenoid of the No. 0 selection guide 27 is energized, and at the same time, the shedding up solenoid and the cut shedding up and down solenoids are energized, and one second after, the yarn introduction lever 6 is angularly moved.

At that time, the yarn introduction lever 6 catches the yarn of the No. 0 selection guide, i.e., the red yarn and then turns to start winding the red yarn around the warper drum A. Then a cut shed of the red yarn is formed by the action of the cut shedding up solenoid and the cut shedding down solenoid. As the yarn passes the photocell C (67*c*), the individual solenoid is deenergized. Partly since the cut shedding bar is located between the photocell B (67*b*) and the photocell C (67*c*), and partly since the shedding bar is located between the photocell A and the photocell B, only the cut shed is formed of the red yarn at the start. When the yarn introduction lever 6 passes the photocell A (67*a*) for the first winding, the multi-winding display will be "1". When it passes the photocell A for the second winding, the multi-winding display will be "0" . Concurrently, the shedding up solenoid and the cut shedding up and down solenoids are energized, and the individual solenoid is deenergized as it passes the next photocell C so that a shed and a cut shed are formed.

Concurrently with this, a total yarns count up signal is issued so that the total yarns counter displays "1". When it passes the photocell A (67*a*) for the third winding, the multi-winding display will be "1". When it passes the photocell A for the fourth winding, the multi-winding display will be "0". At the same time, as the No. 0 yarn selection solenoid, the yarn removing solenoid, the shedding down solenoid, and the cut shedding up and down solenoids are energized, the red yarn is removed from the yarn introduction lever 6 and hence is received in the No. 0 selection guide by the weight of the dropper ring 26.

At that time, when it passes the photocell B, the yarn pressing solenoid will be energized to press the red yarn on the warper drum A so that any yarn slack will not come into the color on the warper drum A. As it passes the next photocell C, the yarn removing solenoid will be deenergized. Concurrently, the total yarns counter displays "2" as the total yarns count up signal is issued. If it passes the photocell A (67*a*) for the fifth winding, the No. 0 yarn selection solenoid will be deenergized, and the No. 1 yarn selection solenoid will be energized. The yarn introduction lever 6 catches the white yarn with the No. 1 yarn selection solenoid to wind the white yarn round the warper drum A. The yarn pressing solenoid also is deenergized. When it passes the next photocell C (67*c*), the No. 1 yarn selection solenoid, the shedding down solenoid, the cut shedding up solenoid and the cut shedding down solenoid will be deenergized. As it passes the photocell A (67*a*) for the sixth winding, the multi-winding display will be "0". Also the shedding up solenoid, the cut shedding up solenoid and the cut shedding down solenoid are energized. As it passes the next photocell C (67*c*), the individual solenoid will be deenergized to form a shed and a cut shed. Simultaneously with this, the total yarns count up signal is issued so that the total yarns counter displays "3".

When it passes the photocell A (67*a*) for the eighth winding, the multi-winding display will be "1". As it passes the photocell A (67*a*) for the ninth winding, the multi-winding display will be "0". At the same time, the No. 1 yarn selection solenoid, the yarn removing solenoid, the shedding down solenoid, the cut shedding up solenoid and the cut shedding down solenoid are energized to remove the white yarn from the yarn introduction lever 6 so that the white yarn is received in the No. 1 yarn selection guide by the weight of the dropper ring 26. At that time, when it passes the photocell B (67*b*), the yarn pressing solenoid is energized to press the yarn on the warper drum A. As it passes the next photocell C (67*c*), the yarn removing solenoid will be deenergized, whereupon the total yarns count up signal will be issued to render the total yarns counter to display "4".

Subsequently, when it passes the photocell A for the tenth winding, the No. 1 yarn selection solenoid will be deenergized, and the No. 0 yarn selection solenoid will be energized (at this time, the multiwinding count does not count). The yarn introduction lever 6 catches the red yarn to wind it round the warper drum A, whereupon the yarn pressing solenoid is deenergized. As it passes the next photocell C (67*c*), the No. 0 yarn selection solenoid, the shedding down solenoid, the cut shedding up solenoid and the cut shedding down solenoid will be energized.

Likewise, as long as any termination signal resulting from yarn breakage, double-yarn stopping, mischange, and right limit switch, and until the total yarns completion termination signal is inputted, the yarn introduction lever 6 is angularly moved, and the individual solenoid is energized/deenergized, so that the conveyor belt keeps feeding the yarn to perform the warping work.

Figure 11:
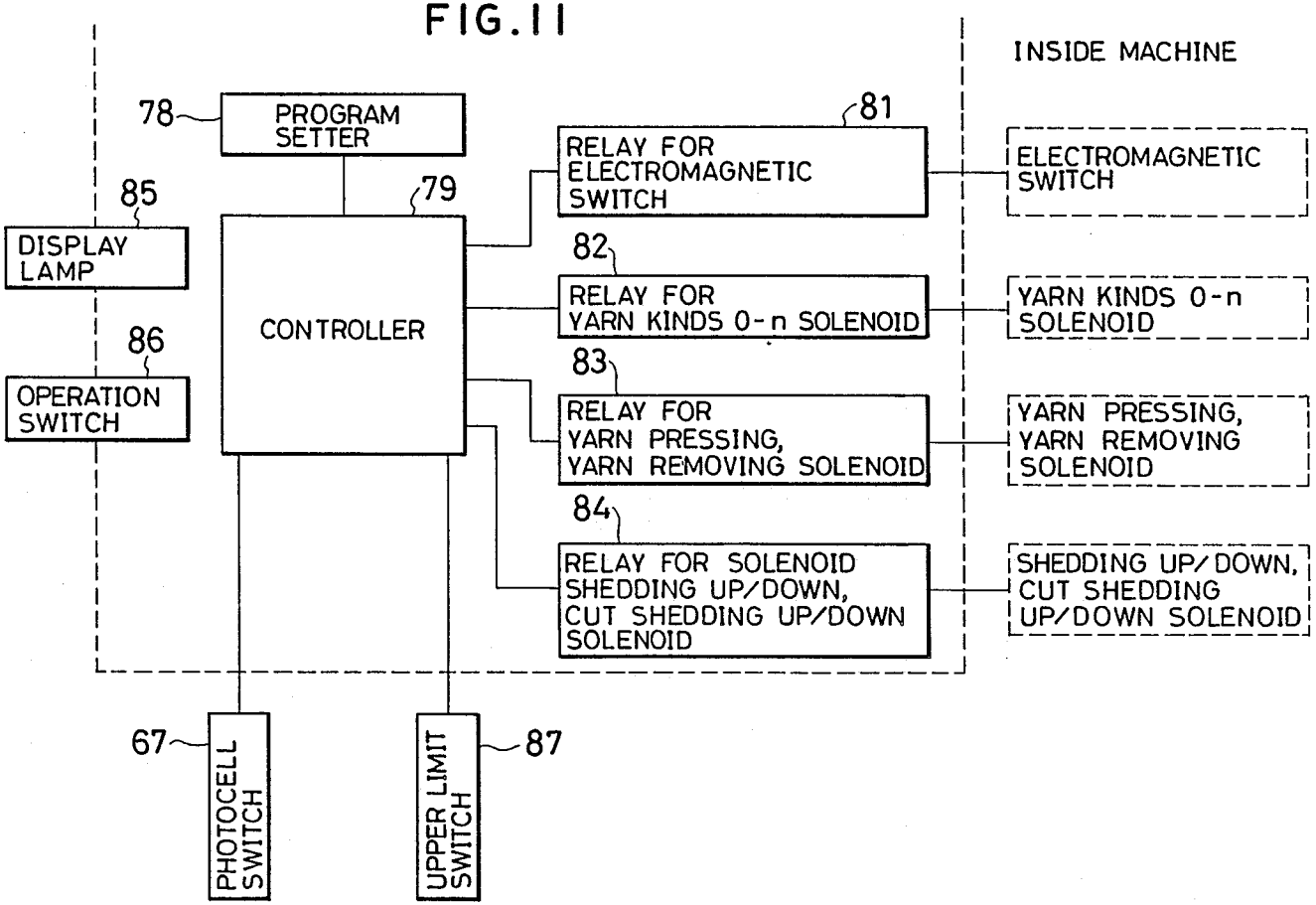
FIG. 11 is a block diagram showing the relations between various parts of the warper.

FIG. 11 shows the control part of the electronically controlled sample warper. The program setting unit 78 is capable of selecting the 0–n number of kinds of yarns, setting the number of yarns and setting of the number of repeats by ten figure key switches of 0–9, a ↑ switch, a ↓ switch, a move switch, a (11) switch, a termination switch, a CLR (clear) switch and a paper feed switch. The thus set program can be printed out by a small-sized printer; the contents of the program, i.e., address, the presence of (11), the kinds of yarns, the number of yarns, and the number of repeats can be displayed by LEDs. The control part includes various switches for storing, operation and reading; it is possible to display the preset contents when in operation, and it is possible to correct the program when reading.

This program setting unit 78 is electronically connected to the controller 79 via the yarn kind signal, the yarn change signal and the count up signal. As these signals are successively received, the preset program is repeated in order. The contents of the program utilizes the four fundamental rules of arithmetic formulae. For example, the program in which ten windings of 1 kind yarn, five windings of 2 kind yarn and seven windings of 3 kind yarn are repeated three times, and thereafter six windings of 4 kind yarn and two windings of 5 kind yarn are added, can be expressed by $(1\times10+2\times5+3\times7)^3+4\times6+5\times2$. For another example, a much more complex program expressed by $\{[(1\times2+2\times3)^3+1\times4]^5+2\times6\}^7+3\times5$ can be prepared.

A program once set is protected by a back-up battery unless the program is changed. The controller 79 controls the warper. Specifically, according to the program preset by the program setting unit 78, the controller 79 controls a relay 81 for electromagnetic switch, a relay 82 for 0–n kind yarn solenoid, a relay 83 for yarn selection, yarn pressing, yarn removing solenoids, a relay 84 for shedding up, shedding down, cut shedding up and cut shedding down solenoids, a display 85, etc., all electrically connected to the controller 79.

The relay 81 for electromagnetic switch controls the switching on/off of the winding motor. The relay for 0–n kind yarn solenoid controls 0–n solenoid when the relay for yarn selection is on. The relay for yarn pressing and yarn removing controls the yarn pressing and the yarn removing solenoids. The relays for shedding up, shedding down, cut shedding up and cut shedding down control the shedding up, shedding down, cut shedding up and cut shedding down solenoids, respectively.

The display lamps 85 are lamps for displaying the operation states of the warper. Specifically, the display lamps 85 display the power source on, the rightward movement of the conveyor belt, the leftward movement of the conveyor belt, the shedding up, the shedding down, the energization of the main motor, the double winding, the total number of yarns, the multi-winding.

The operation switches 86 are switches for controlling the warper. Specifically, the operation switches 86 controls the power source, the automatic termination of the warper motor, the multi-winding setting, the conveyor belt movement termination, the rightward movement of the conveyor belt, the leftward movement of the conveyor belt, the shedding up, the shedding down, the energization of the main motor, the deenergization of the main motor, the double winding reset switch, the total yarns counter, etc.

The photocell switches 67 are composed of three photocell switches or sensors 67*a*, 67*b*, 67*c* supported on the warper. These three photocell switches 67*a*, 67*b*, 67*c* are arranged one at each of generally trisectional circumferential positions for timing between the yarn selection, the yarn pressing, the yarn removing, the shedding, the cut shedding, the scouting up, etc.

A switch 87 for double-winding termination detects whether the yarns on the creel stand B for fixed supply yarn are wound two at a time and transmits a signal to the controller 79. The warper is also equipped with a yarn breakage detection switch for terminating the main motor 46, various solenoid to be controlled the above-mentioned relays, an electromagnetic switch, a mischange display, etc.

In addition, though there is no illustration in the drawings, the warper also includes: an inverter for inputting an operation termination signal, a jogging signal, a multi-step speed change signal and a forward-/reverse rotation signal via the controller (sequence board) 79 to control the rotation of the main motor 46; and an AC servo motor control part for inputting a conveyor belt rightward movement signal, a conveyor belt leftward movement signal, an operation termination signal, the warp width, the number of warp yarns, the number of windings, a photocell A signal, etc. via the controller (sequence board) 79, the multi-winding setting unit RS1 and the warp length setting unit 90 to control the angle of rotation of the conveyor belt motor 51.

Figure 12:
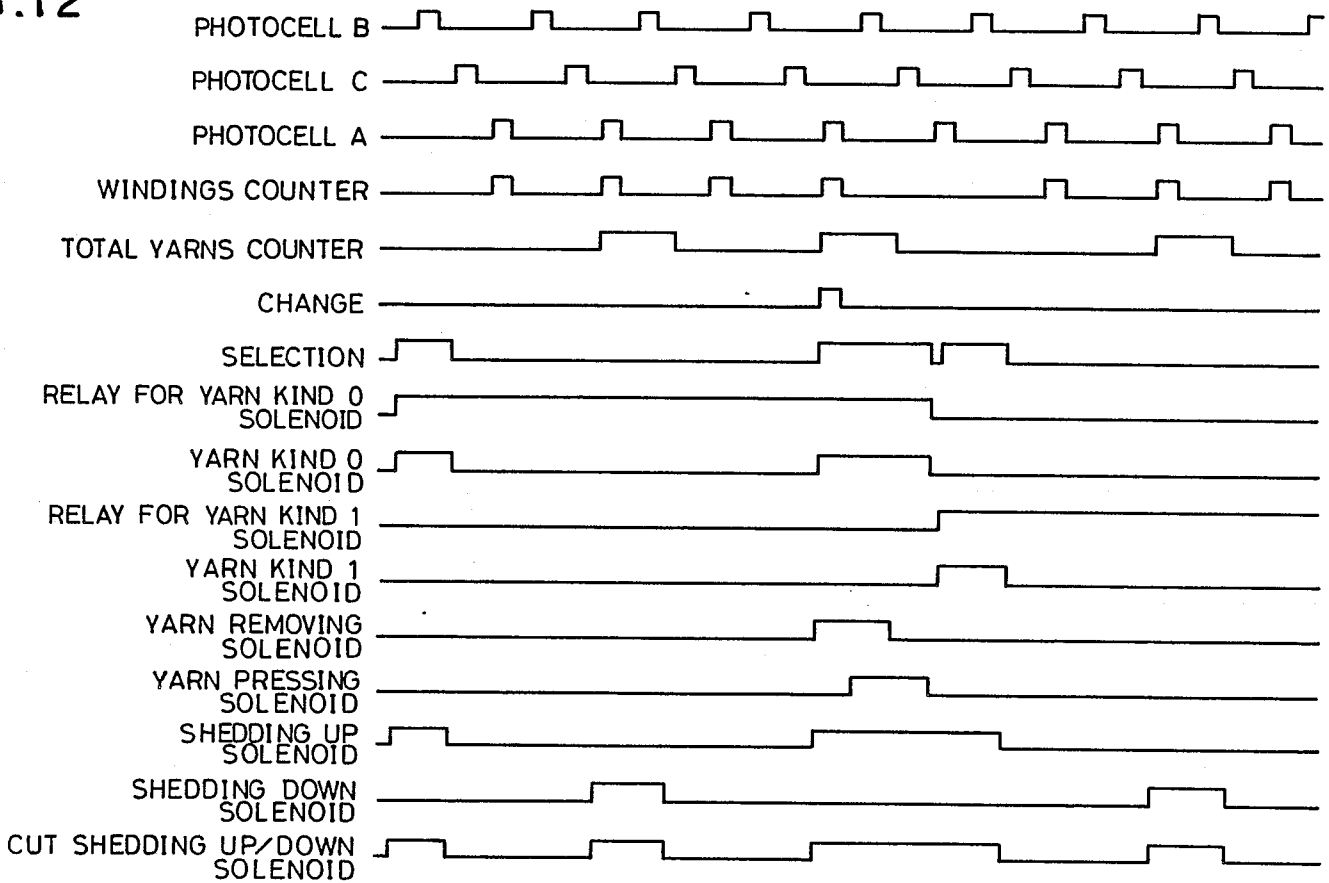
FIG. 12 is a timechart showing the sequential operations of the warper.

FIG. 12 is a timechart showing the operation of the electronically controlled sample warper.

According to this timechart, a double winding of 0 kind yarn is wound twice, and a double winding of 1 kind yarn is wound twice, whereupon these are repeated. Here "double winding" is a value preset in the range of from 0 to 19 by the multi-winding setting switch. The signals from these three photocell switches are called here "photocell A", "photocell B" and "photocell C". The operation starts between the photocell switch A and the photocell switch B. whereupon photocell B - photocell C - photocell A - photocell B - photocell C - photocell A are successively issued. Hereinafter these signals are utilized to take the following timing.

A count signal is issued each and every time the photocell A detects that the slit 28*a* of the slitted plate 28 passes; the count signal is not issued only at one time after a change signal received from the program setting unit, for the yarn introduction lever 6 is angularly moved without any load. A count up signal will be on between the photocell A and the photocell C every time it reaches a preset multi-winding value. The count up signal renders the total yarns counter up. Thus a count up signal is transmitted to the program setting unit.

A change (yarn exchange) signal is transmitted from the program setting unit in synchronism with the photocell A and is used in changing the yarn kind. A selection signal transmits a signal to one of 0–n kind yarn solenoids when a corresponding one of the relays for 0–n kind yarn solenoids. This solenoid is on between the start time and the photocell C, whereupon a confirmation is made as to whether the change signal is received. The solenoid will be on between the photocell A and the next photocell A, will be off for a short time (10 to 50 ms), immediately then will be on, and will be on until the next photocell C.

The relays for 0, 1 kind yarn solenoids are adjusted in timing by the controller based on the yarn kind setting signal transmitted from the program setting unit, and is kept energized until a selection signal for yarn changing is issued. The yarn removing solenoid signal is on between the photocell A and the photocell C after it is confirmed that a change signal has been received. The yarn pressing solenoid signal is on between the photocell B and the photocell A after the yarn removing solenoid signal has been on.

The shedding up solenoid signal and the shedding down solenoid signal may be started from either signal and will be on alternately. Between the start and the photocell C, either signal confirms that a count up signal is on not during the yarn changing and that a change signal is received. Then either signal will be on for a period of time from the photocell A and the next photocell C. Though there is no illustration in the timechart of FIG. 12, if one of the shedding up and down solenoid signals is on, both the cut shedding up and down solenoid signals will be on.

Further, by varying the timing of the shedding up and down solenoid signals, it it possible to form sheds of different kinds which can be rewound directly on a weaving beam 49. The warper starts its operation by switching the start switch on and terminates its operation by switching the termination switch on. Alternatively, the warper may be terminated by the double-winding termination switch for checking the state of winding two or more yarns at one time as well as by the mischange signal to notify the state of not winding the yarn during the yarn changing, the total yarns completion signal to be transmitted also from the total yarns counter to notify the completion of winding the total yarns, the yarn breakage detection signal to notify the yarn breakage, etc.

Figure 18:
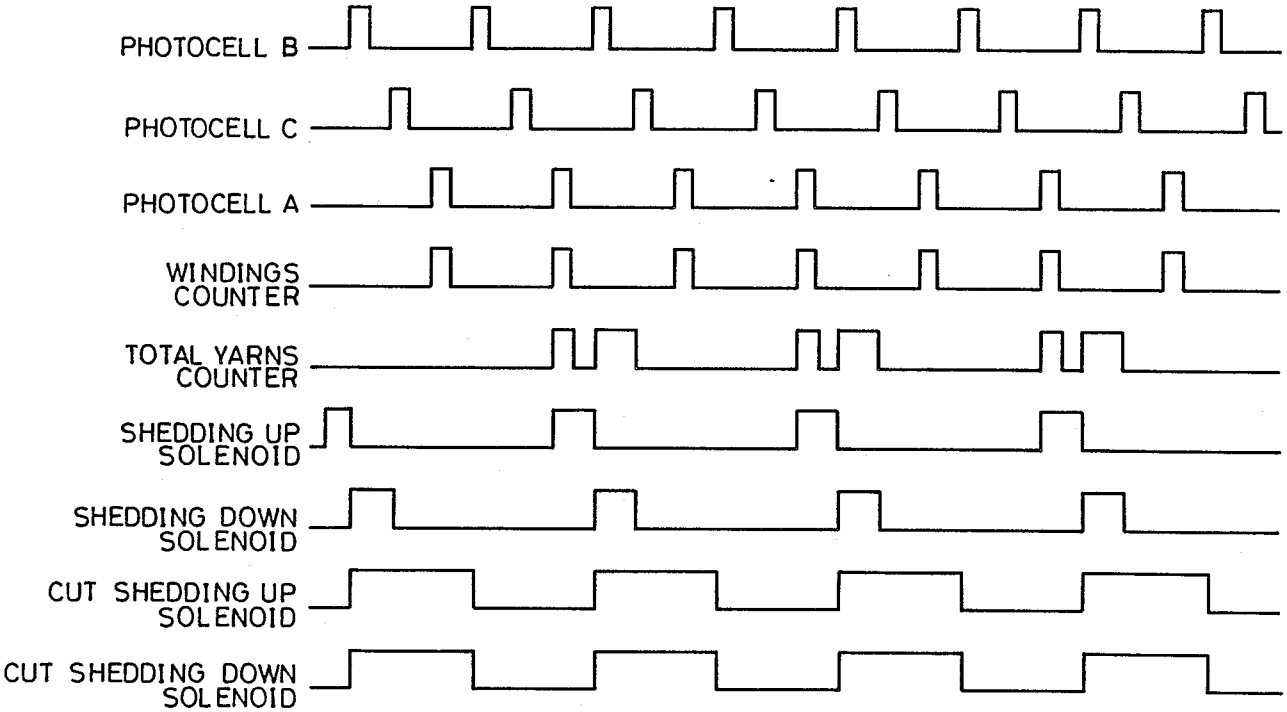
FIG. 18 is a timechart when the rotary creel is in use.
Figure 19:
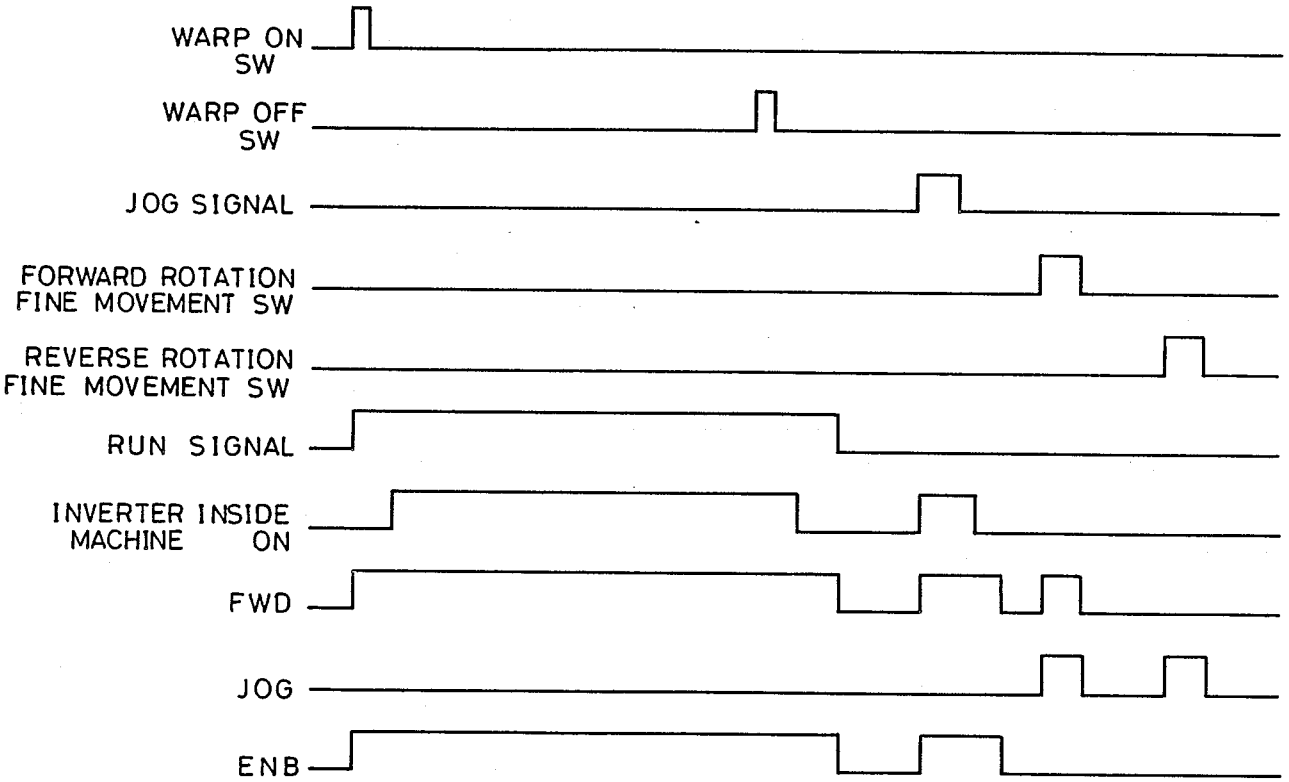
FIG. 19 is a timechart showing the sequential operations of the rotary creel.

FIGS. 18 and 19 are timecharts showing the operation of the electronically controlled sample warper which is capable of warping a plurality of yarns concurrently.

Specifically, the timechart of FIG. 18 illustrates the example in which using the rotary creel F, the two yarns are caught one by each of the yarn introduction parts 6', 6' displaced circumferentially by 180° and then are wound twice (two windings) in the shedding up mode (the shedding of the yarn to be wound on the warper drum A starts with the shedding up). The yarn to be wound on the warper drum A is engaged on one of the yarn introduction part 6' aligned with the slit 28*a* of the slitted plate 28, and this yarn introduction part 6' starts from between the photocell A and the photocell B. At that time, as discussed above, since the yarn exchanging step is omitted, the yarn selection solenoid, the yarn pressing solenoid, the yarn removing solenoid, etc. will not be energized.

A multi-winding counter signal is issued every time the photocell A detects the passage of the slit 28*a* of the slitted plate 28. The total yarns counter count up signal will be on/off twice. At that time, the value of the total yarns counter advances 2 up per multi-winding. The shedding up solenoid will be on from the start until the photocell B is on, whereupon the shedding up solenoid will be on from the energization of the photocell A to the energization of the photocell B until it reaches a preset multi-winding value.

The shedding down solenoid will be on concurrently with the deenergization of the shedding up solenoid and will be off upon energization of the photocell C. Both the cut shedding up solenoid and the cut shedding down solenoid will be on concurrently with the energization of the shedding down solenoid. At that time, the photocell B is on. However, if the photocell B is off and is then on again, these solenoids will be off.

The posture of the yarn wound on the warper drum A is such that using the creel stand B for fixed yarn supply, the double winding (number of turns is 2) of 0 kind yarn and the double winding (number of turns is 2) of 1 kind yarn are repeated alternately. Partly since the yarn exchanging step is omitted, and partly since the two yarns are concurrently wound on the warper drum A as the yarn introduction part 6' makes one rotation, the warping work can be reduced to a minimum.

FIG. 19 is a timechart showing various signals to be inputted to an inverter to synchronize a rotary shaft 107 of the rotary creel F with the operation of the yarn introduction part 6'.

A RUN signal will be on one second earlier and off one second later than the inverter built in the electronically controlled sample warper W. The RUN signal will be on when the warping ON switch is switched on, and will be off one second after a detection is made whether the warping OFF switch is on.

An FWD signal gives a forward rotation command to the inverter 113 built in the rotary creel F. This FWD signal will be on for the same period as the RUN signal, whereupon the FWD signal will be on when the JOG signal (jogging signal) to be inputted from the electronically controlled sample warper W is on. One second after the JOG signal has been off, the FWD signal will be off. The FWD will be on also while the forward rotation fine movement switch on the rotary creel F.

An ENB signal (synchronization variable signal) will be on while the FWD signal is on upon receipt of the RUN signal and the JOG signal, both inputted from the electronically controlled sample warper W. Because the main motor 46 of the warper W is preset so as to be terminated before the ENB signal is off, the warper W performs a synchronous operation always while the yarn introduction part 6' is in rotation.

The JOG signal renders the rotary shaft 107 of the rotary creel F and will be on while either the forward rotation fine movement switch or the reverse rotation fine movement switch is depressed. At that time, only the rotary shaft 107 of the rotary creel F is in rotation, instead of synchronous operation. This JOG signal is used in locating the yarn introduction part 6' and the bobbin 106 in register with each other. The inverter 113 gives to the reducered motor 101 a rotation command for synchronous operation, upon comparison of these signals with the angle of rotation of the encoder 97 built in the warper W or with the angle of rotation of the encoder 100 supported on the rotary creel F.

In the foregoing description, the yarn kinds are 0–n, and n usually stands for a digit up to 9 but may be more than 9. In the above description, the number of windings is 1–19 but should by no means be limited to these specific figures. The relay part, i.e., the driver part of the solenoid may be a semiconductor such as a transistor or a thyristor. The switch of each of the photocells A, B, C may be a magnet-sensitive element, a mechanical limit switch or the like. The controller is a microcomputer, a memory, a TTL, a CMOS a, a photocoupler or the like, and may be an ordinary sequence controller.

The inverter, which serves to perform a synchronous operation, may be replaced by an AC servo motor. For supporting three or more yarns on the rotary creel F, separate timing sensors are required, in addition to the photocells A, B, C to control the shedding up solenoid, the shedding down solenoid, the cut shedding up solenoid and cut shedding down solenoid in on/off timing, to render the multiple total yarns count up signals operative/inoperative for a constant period of time and to increase the number of feed pitches of the conveyor belt multiple times.

Figure 13:
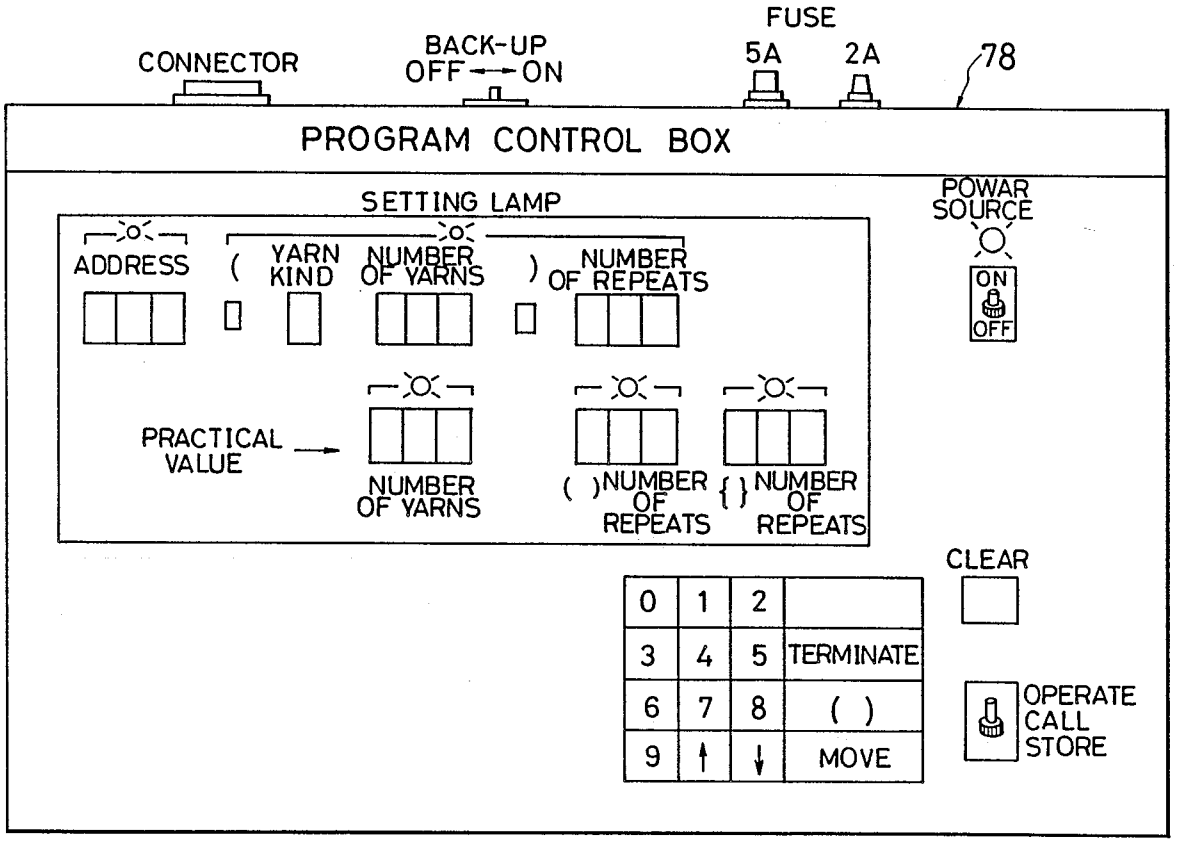
FIG. 13 is a view showing a panel surface of a program setting unit.
Figure 14:
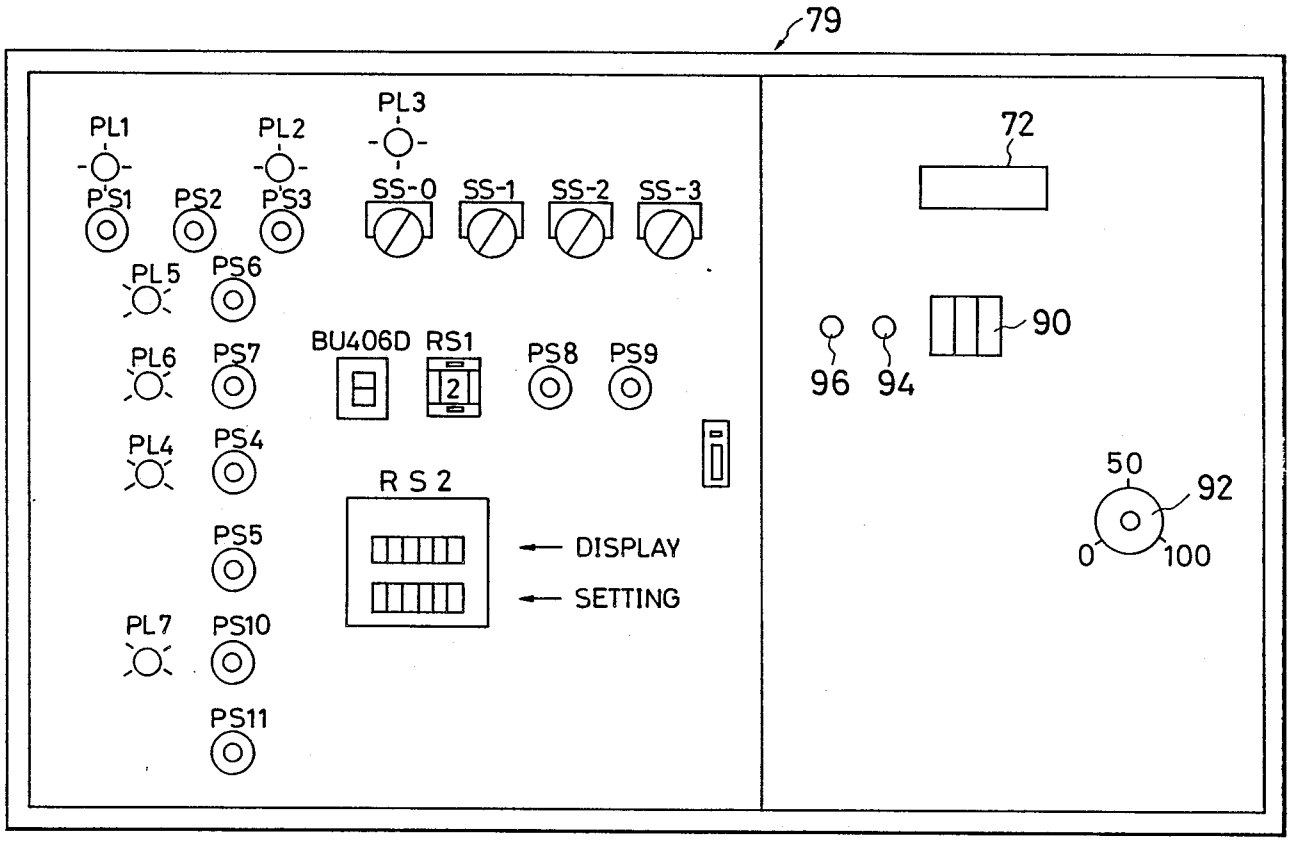
FIG. 14 is a view showing a panel surface of a controller.

FIG. 13 shows the board surface of the program setting unit 78, and FIG. 14 shows the board surface of the controller 79. In FIG. 14, PL1 designates a belt fast feed leftward movement display lamp; PL2, a belt fast feed rightward movement display lamp; PL3, a power source display lamp; PL4, a main motor ON display lamp; PL5, a shedding up display lamp; PL6, a shedding down display lamp; PL7, a double winding termination display lamp; SS-0, a power source switch; SS-1, a midnight power source switch; SS-2, a main motor forward/reverse rotation switch; SS-3, a mischange circuit switch; PS1, a belt leftward movement switch; PS2, a belt fast feed termination switch; PS3, a belt fast feed rightward movement switch; PS4, a main motor ON switch; PS5, a main motor OFF switch; PS6, a shedding up switch; PS7, a shedding down switch; PS8, a multi-winding manual count switch; PS9, a multi-winding count reset switch; PS10, a double winding reset switch; PS11, a main motor reverse rotation fine movement switch; RS1, a multi-winding setting switch; BU406D, a number-of-winding setting unit; RS2, a warp yarns setting unit.

Further, 72 designates a warp yarn speed meter; 90, a warp length setting unit; 92, a maximal-number-of-rotations setting dial of the main motor 46. The maximal number of rotations of the main motor 46 may be set also by a setter built in the inverter. 94 and 96 respectively designate a belt feed rightward fine movement switch and a belt feed leftward fine movement switch. These two switches are correction switches in which the one pitch feeding of the conveyor belt can be possible by the mechanical switch when the main motor is off.

In the illustrated embodiment, two yarn introduction levers 6, 6 are located in confronting relation to each other and have at their respective distal ends a pair of yarn introduction parts 6', 6' to wind two yarns round the warper drum. Alternatively, three or more yarn introduction levers 6, 6, 6 may be provided and have at their respective distal ends three or move yarn introduction parts 6', 6', 6' to wind three or more yarns round the warper drum. Further, although a plurality of yarn introduction levers 6 are located preferably at regular spaces for balance, a bar may be used to take a balance so that the yarn introduction levers 6 must not be spaced equidistantly.

As described above, according to this invention, since the rotary creel in addition to the conventional fixed creel is provided so that two or three or more yarns can be wound round the warper drum concurrently and accurately as they are brought selectively over and under the shedding bars and cut shedding bars, it is possible to reduce the warping operation to a minimum.

What is claimed is:

1. An electronically controlled sample warper for automatically warping in a desired pattern of yarns by selecting the kinds of yarns from 0 through n and by setting the number of yarns, the number of repeats, the number of windings, the amount of movement of a conveyor belt, which comprises: driving and driven shafts projecting centrally from opposite ends of a hollow shaft cantilevered at the driving-shaft side; a first small gear loosely mounted on the driving shaft and fixed to a pulley; a second small gear loosely mounted on the driven shaft and fixed to a yarn introduction lever, the distal end of the yarn introduction lever being bent inwardly to provide a yarn introducing part disposed adjacent to the front end of the outer periphery of the warper drum; third and fourth small gears mounted on opposite ends of an auxiliary shaft extending through the hollow shaft and meshing the first and second small gears, respectively, to cooperate with each other; drum frames mounted on the driven-shaft side of the hollow shaft and each having an outer periphery having alternately an arcuate portion and a straight portion; a pair of rollers disposed one on the arcuate portion of each of the drum frames; a warper drum loosely mounted on the hollow shaft and having horizontal beams carrying the rollers around which conveyor belts are wound, the conveyor belts being simultaneously driven to a common amount of fine movement by a drive member threadedly engaged with interior screw shafts of planetary gears meshing with a sun gear suitably driven from the exterior; as the sun gear rotates, the planetary gears rotates concurrently; a shedding means for forming a shed and a cut shed by selecting the warp yarns over and under shedding bars and cut shedding bars; a total yarns counter count means for rendering an up signal, of a total counter for counting the total number of the warp yarns, to be on or off; a total yarns completion termination means for terminating the operation of the warper when the total number of the warp yarns reaches a predetermined value; a conveyor belt leftward moving means for moving the conveyor belt leftwardly; a conveyor belt rightward moving means for moving the conveyor belt rightwardly; an operation/-termination means for transmitting the rotation of a main motor to the yarn introduction lever; a yarn selection means for controlling a yarn selection guide and a yarn removing unit; a yarn pressing solenoid means for rendering a solenoid of a yarn relaxation preventing unit operative and inoperative; and a windings count means for counting the number of windings of the yarns and for displaying the counted result; characterized in that the warper includes a plurality of the yarn introduction levers each having a distal end inwardly bent to provide a yarn introduction part, and also includes a rotary creel for supporting a plurality of bobbins on which a plurality of kinds of yarns are wound respectively.

* * * * *